US009945127B2

(12) United States Patent
Edwards et al.

(10) Patent No.: US 9,945,127 B2
(45) Date of Patent: Apr. 17, 2018

(54) ABOVE-DECK ROOF VENTING ARTICLE, SYSTEM AND METHODS

(75) Inventors: John S. Edwards, Weston, WI (US); Frank W. Klink, Oak Park Heights, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 1188 days.

(21) Appl. No.: 13/818,389

(22) PCT Filed: Sep. 7, 2011

(86) PCT No.: PCT/US2011/050664
§ 371 (c)(1),
(2), (4) Date: Apr. 30, 2013

(87) PCT Pub. No.: WO2012/033816
PCT Pub. Date: Mar. 15, 2012

(65) Prior Publication Data

US 2013/0217318 A1 Aug. 22, 2013

Related U.S. Application Data

(60) Provisional application No. 61/380,863, filed on Sep. 8, 2010.

(51) Int. Cl.
*E04D 13/17* (2006.01)
*E04D 1/24* (2006.01)
*E04D 1/28* (2006.01)

(52) U.S. Cl.
CPC ..... *E04D 13/178* (2013.01); *E04D 1/24* (2013.01); *E04D 1/28* (2013.01); *E04D 13/17* (2013.01)

(58) Field of Classification Search
CPC ..... F24F 7/02; E04D 1/30; E04D 2001/309; E04D 13/14; E04D 1/24; E04D 1/28; E04D 13/17; E04D 13/178
USPC ..... 454/366, 250; 52/199, 198, 748.1
See application file for complete search history.

(56) References Cited

U.S. PATENT DOCUMENTS

| | | | | |
|---|---|---|---|---|
| 1,259,914 A | | 3/1918 | Seward | |
| 2,477,152 A | | 7/1949 | Stevenson | |
| 2,565,131 A | * | 8/1951 | Johnson | F24F 7/02 454/366 |

(Continued)

FOREIGN PATENT DOCUMENTS

| | | |
|---|---|---|
| GB | 2 262 295 | 6/1993 |
| GB | 2345536 | 7/2000 |

(Continued)

OTHER PUBLICATIONS

3M Interam Graphite Mat (Ultra GS) product data. 1998.*
European Application No. 11824056 Supplementary Search Report dated May 21, 2014.

*Primary Examiner* — Steven B McAllister
*Assistant Examiner* — Ko-Wei Lin
(74) *Attorney, Agent, or Firm* — Daniel J. Iden

(57) ABSTRACT

A roofing article having a body, a first channel defined within an upper portion of said body having an inlet through which outside air can enter the first channel, and a second channel defined in a lower portion of said body. A sheet separates the second channel from the first channel. The second channel is operably connected to the first channel through an orifice in the sheet such that the outside air can enter the second channel through the orifice.

16 Claims, 17 Drawing Sheets

(56) References Cited

U.S. PATENT DOCUMENTS

| | | | | |
|---|---|---|---|---|
| 3,006,113 | A | 10/1961 | Barnes | |
| 3,058,265 | A | 10/1962 | Lapsensohn | |
| 3,660,955 | A | 5/1972 | Simon | |
| 3,683,785 | A | 8/1972 | Grange | |
| 3,686,813 | A | 8/1972 | Breitwieser | |
| 3,797,180 | A | 3/1974 | Grange | |
| 4,125,971 | A | 11/1978 | Ward | |
| 4,189,878 | A | 2/1980 | Fitzgerald | |
| 4,237,672 | A | 12/1980 | Peterson | |
| 4,254,598 | A | 3/1981 | Rugroden | |
| 4,406,095 | A | 9/1983 | Slavik | |
| 4,446,661 | A | 5/1984 | Jonsson | |
| 4,558,637 | A * | 12/1985 | Mason | E04D 1/3402 454/365 |
| 4,635,419 | A | 1/1987 | Forrest | |
| 4,642,518 | A | 2/1987 | Dard | |
| 4,660,463 | A | 4/1987 | Bottomore | |
| 4,677,903 | A | 7/1987 | Mathews, III | |
| 4,781,243 | A | 11/1988 | DeVogel | |
| 4,852,314 | A | 8/1989 | Moore, Jr. | |
| 4,977,714 | A | 12/1990 | Gregory, Jr. | |
| 5,060,444 | A | 10/1991 | Paquette | |
| 5,295,339 | A | 3/1994 | Manner | |
| 5,524,381 | A | 6/1996 | Chahroudi | |
| 5,549,513 | A | 8/1996 | Thomas | |
| 5,596,847 | A | 1/1997 | Stephenson | |
| 5,600,928 | A | 2/1997 | Hess | |
| 5,630,752 | A | 5/1997 | Gubash | |
| 5,673,521 | A | 10/1997 | Coulton | |
| 5,766,071 | A | 6/1998 | Kirkwood | |
| 6,049,419 | A | 4/2000 | Wheatley | |
| 6,061,978 | A * | 5/2000 | Dinwoodie | E04D 13/17 136/244 |
| 6,092,344 | A | 7/2000 | Kelly | |
| 6,346,040 | B1 | 2/2002 | Best | |
| 6,357,193 | B1 | 3/2002 | Morris | |
| 6,487,826 | B1 | 12/2002 | McCorsley | |
| 6,780,099 | B1 | 8/2004 | Harper | |
| 6,797,396 | B1 | 9/2004 | Liu | |
| 6,927,900 | B2 | 8/2005 | Liu | |
| 6,955,012 | B2 | 10/2005 | Suzuki | |
| 7,077,124 | B2 | 7/2006 | Szymocha | |
| 7,169,459 | B2 | 1/2007 | Lichodziejewski | |
| 7,231,744 | B2 | 1/2007 | Cooper | |
| 7,240,804 | B2 | 7/2007 | King | |
| 7,302,776 | B2 | 12/2007 | Duncan | |
| 7,389,699 | B2 | 6/2008 | Kelly | |
| 7,455,899 | B2 | 11/2008 | Gross | |
| 7,565,775 | B2 | 7/2009 | Cooper | |
| 7,648,755 | B2 | 1/2010 | Gross | |
| 7,758,408 | B2 | 7/2010 | Hagentoft | |
| 7,805,905 | B2 | 10/2010 | Rodrigues | |
| 8,065,841 | B2 | 11/2011 | Antonic | |
| 2001/0009714 | A1 | 7/2001 | Wheatley | |
| 2003/0126806 | A1 | 7/2003 | Ellis | |
| 2005/0243425 | A1 | 11/2005 | Wheatley | |
| 2005/0246973 | A1 | 11/2005 | Jensen | |
| 2006/0121845 | A1 | 6/2006 | Sells | |
| 2006/0218869 | A1 | 10/2006 | Ellis | |
| 2007/0072541 | A1 | 3/2007 | Daniels, II | |
| 2007/0207725 | A1 * | 9/2007 | O'Hagin | E04D 13/008 454/365 |
| 2007/0243820 | A1 | 10/2007 | O'Hagin | |
| 2008/0098674 | A1 * | 5/2008 | Daniels | E04D 1/045 52/199 |
| 2008/0113612 | A1 | 5/2008 | Chich | |
| 2008/0152867 | A1 | 6/2008 | Di Pede | |
| 2008/0236058 | A1 | 10/2008 | Antonie | |
| 2009/0203308 | A1 | 8/2009 | O'Hagin | |
| 2010/0167013 | A1 * | 7/2010 | Cruz | B32B 27/08 428/147 |
| 2010/0229498 | A1 | 9/2010 | Pollack | |
| 2010/0330898 | A1 | 12/2010 | Daniels | |
| 2011/0030287 | A1 | 2/2011 | Moore | |
| 2011/0265407 | A1 | 11/2011 | Bryson | |
| 2012/0266553 | A1 | 10/2012 | Shiao | |

FOREIGN PATENT DOCUMENTS

| | | |
|---|---|---|
| JP | S63-25719 | 2/1988 |
| WO | WO 1998/31894 | 7/1998 |
| WO | WO 2006/063333 | 6/2006 |
| WO | 2012/033816 | 3/2012 |

* cited by examiner

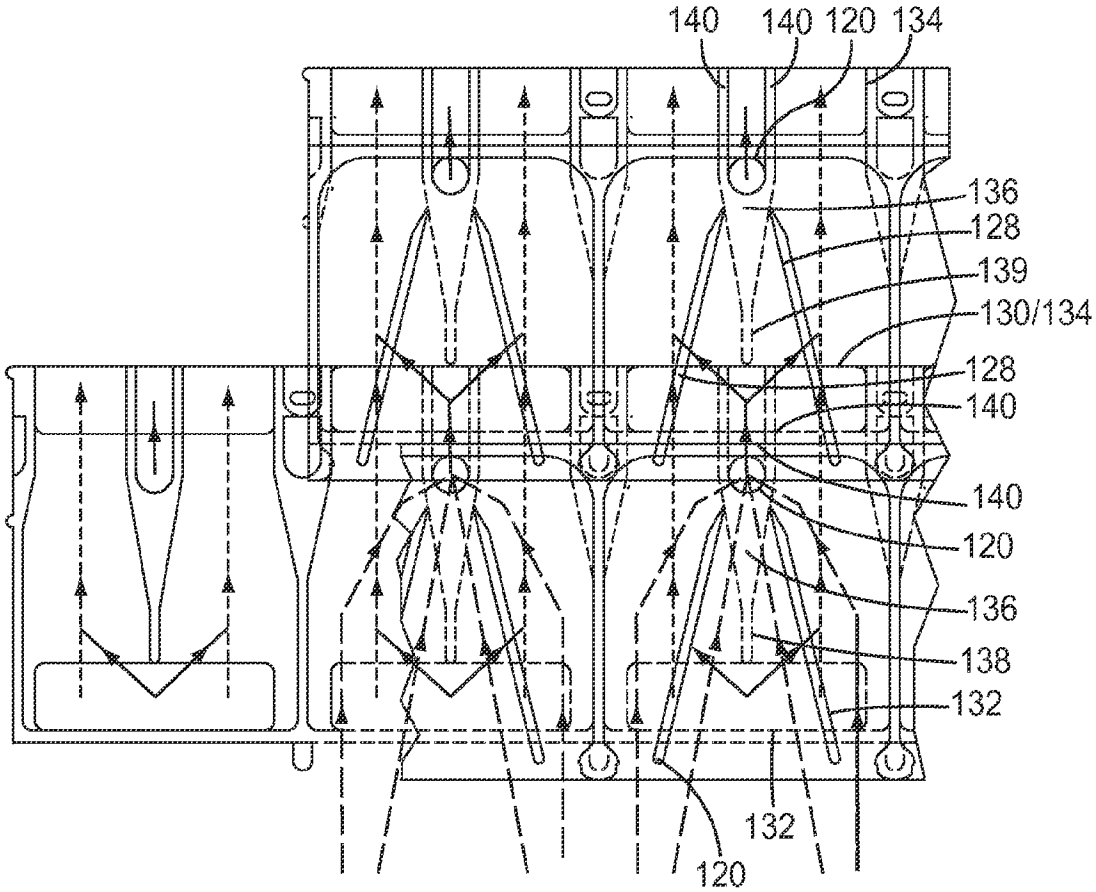
FIG. 11
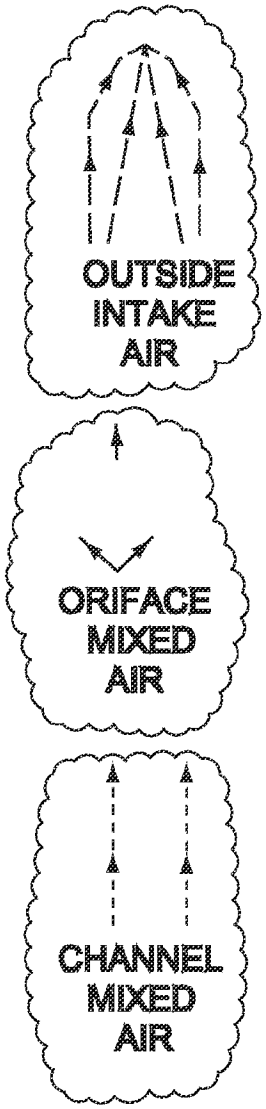

ABOVE-DECK ROOF VENTING ARTICLE, SYSTEM AND METHODS

CROSS REFERENCE TO RELATED APPLICATIONS

The present application claims priority to and the benefit of U.S. Provisional Application No. 61/380,863, entitled "Above-Deck Roof Venting Article, System and Methods" filed Sep. 8, 2010, which is hereby incorporated herein by reference in its entirety.

FIELD

The present disclosure generally relates to roofing materials. More particularly, the present disclosure relates to a roofing article having an airflow path therein.

BACKGROUND

It can be desirable to use construction articles that provide energy conservation advantages for buildings and housing structures. Absorbed solar energy increases cooling energy costs in buildings, particularly in warm southern climates, which can receive a high incidence of solar radiation. An absorber of solar energy is building roofs. It is not uncommon for the air temperature within an attic or unconditioned space that is adjacent to or under a roof, to exceed the ambient air temperature by 40° F. (about 22.2° C.) or more, due in part to absorption of solar energy by the roof or conduction of the solar energy through the roof. This can lead to significant energy costs for cooling the interior spaces of a building to a comfortable living temperature.

SUMMARY

In aspects, a roofing article for installation on a roof deck includes a body, a first channel defined within an upper portion of the body having an inlet through which outside air can enter the first channel, and a second channel defined in a lower portion of the body. A sheet separates the second channel from the first channel. The second channel is operably connected to the first channel through an orifice in the sheet, such that the outside air can enter the second channel through the orifice.

In aspects, a roofing article includes a body and an air pathway defined in the body. The air pathway includes an inlet through which outside air can enter the air pathway. The roofing article further includes an airflow interrupter presented with the air pathway for at least partially closing the pathway when the airflow interrupter is exposed to heat.

In aspects, a roofing panel includes a plurality of roofing articles according to embodiments of the present disclosure.

In aspects, a roofing system includes at least two roofing articles. Each roofing article includes a body and a first channel defined within an upper portion of the body. The first channel includes an inlet through which outside air can enter the first channel. The roofing article further includes a second channel defined in a lower portion of the body, wherein a sheet separates the second channel from the first channel. The second channel is operably connected to the first channel through an orifice in the sheet such that the outside air can enter the second channel through the orifice. The second channels of each of the at least two roofing articles are in airflow communication so as to create an airflow path between the at least two roofing articles.

In aspects, a roofing system comprises at least two roofing articles, each roofing article comprising a body, a channel defined in the body, the channel comprising an inlet port and an outlet port, and first and second connection members for interconnecting the at least two roofing articles. When at least two roofing articles are connected using the first and second connection members, the outlet port of one of the at least two roofing articles is substantially aligned with the inlet port of the other of the at least two roofing articles to create an airflow path between the at least two roofing articles.

The subject matter of the present disclosure, in its various combinations, either in apparatus or method form, may be characterized by the following list of embodiments:

1. A roofing article for installation on a roof deck, said roofing article comprising:

a body;

a first channel defined within an upper portion of said body, said first channel comprising an inlet through which outside air can enter said first channel; and a second channel defined in a lower portion of said body, wherein a sheet separates said second channel from said first channel, said second channel being operably connected to said first channel through an orifice in said sheet such that the outside air can enter said second channel through said orifice.

2. The roofing article of embodiment 1, wherein said second channel comprises an outlet port, wherein the outside air can exit said second channel through said outlet port.

3. The roofing article of any of the preceding embodiments, wherein said second channel comprises an inlet port, wherein air from an adjacent roofing article can enter said second channel through said inlet port.

4. The roofing article of embodiment 3, wherein said second channel is in airflow communication with an unconditioned space and wherein unconditioned air from the unconditioned space can enter said second channel through said inlet port.

5. The roofing article of embodiment 4, wherein the unconditioned air entering said second channel through said inlet port can mix with outside air entering said second channel through said orifice to form mixed air, wherein said mixed air can exit said second channel through said outlet port.

6. The roofing article of any of embodiments 4 or 5, wherein the unconditioned space is an attic.

7. The roofing article of any of the preceding embodiments, further comprising insulation presented below said second channel.

8. The roofing article of any of the preceding embodiments, wherein said first channel comprises an first channel upper internal surface and a first channel lower internal surface, wherein one or more of said first channel upper and lower internal surfaces comprises a radiant barrier presented therewith.

9. The roofing article of any of the preceding embodiments, wherein said second channel comprises an second channel upper internal surface and a second channel lower internal surface, wherein one or more of said second channel upper and lower internal surfaces comprises a radiant barrier presented therewith.

10. The roofing article of any of the preceding embodiments, further comprising a third channel defined in a lower portion of said body, wherein a second sheet separates said third channel from said second channel.

11. The roofing article of embodiment 10, wherein said third channel is in airflow communication with an unconditioned space.

12. The roofing article of embodiment 11, wherein the unconditioned space is an attic.

13. The roofing article of any of the preceding embodiments, further comprising an air director presented in said first channel proximate said orifice to direct outside air into orifice.

14. The roofing article of any of the preceding embodiments, further comprising an airflow interrupter presented with said air pathway for at least partially closing at least one of said first channel or said second channel when said airflow interrupter is exposed to temperatures at or greater than about 350 degrees Fahrenheit.

15. The roofing article of embodiment 14, wherein said airflow interrupter comprises an intumescent material.

16. The roofing article of any of the preceding embodiments, further comprising a cover presented with said inlet, said cover enabling outside air to flow therethrough into said first channel.

17. The roofing article of any of the preceding embodiments, wherein a ratio of a cross section of said inlet to a cross section of said orifice is between about 2 to about 48.

18. The roofing article of any of the preceding embodiments, wherein a ratio of a cross section of said inlet to a cross section of said orifice is between about 1 to about 12.

19. A roofing article comprising:

a body;

an air pathway defined in said body, said air pathway comprising an inlet through which outside air can enter said air pathway; and an airflow interrupter presented with said air pathway for at least partially closing said pathway when said airflow interrupter is exposed to heat.

20. The roofing article of embodiment 19, wherein the heat is a temperature of at or greater than about 350 degrees Fahrenheit.

21. The roofing article of embodiment 18, wherein said airflow interrupter comprises an intumescent material.

22. The roofing article of embodiments 19-21, further comprising a cover presented with said inlet, said cover enabling outside air to flow therethrough into said air pathway.

23. A roofing panel comprising a panel comprised of a plurality of roofing articles of any of the preceding embodiments.

24. The roofing panel of embodiment 23, wherein at least a portion of plurality of roofing articles are integrally formed.

25. A roofing system comprising at least two roofing articles, each roofing article comprising:

a body;

a first channel defined within an upper portion of said body, said first channel comprising an inlet through which outside air can enter said first channel; and a second channel defined in a lower portion of said body, wherein a sheet separates said second channel from said first channel, said second channel being operably connected to said first channel through an orifice in said sheet such that the outside air can enter said second channel through said orifice, wherein the second channels of each of the at least two roofing articles are in airflow communication so as to create an airflow path between the at least two roofing articles.

26. The roofing system of embodiment 25, wherein the second channel of each of the at least two roofing articles comprises an outlet port, wherein the outside air can exit said second channel through said outlet port.

27. The roofing system of any of embodiments 25-26, wherein the second channel of each of the at least two roofing articles comprises an inlet port, wherein air from an adjacent roofing article can enter said second channel through said inlet port.

28. The roofing system of embodiment 27, wherein the second channel of each of the at least two roofing articles is in airflow communication with an unconditioned space and wherein unconditioned air from the unconditioned space can enter said second channel through said inlet port.

29. The roofing system of any of embodiments 27-28, wherein the unconditioned air entering said second channel of each of the at least two roofing articles through said inlet port can mix with outside air entering said second channel of the at least two roofing articles through said orifice to form mixed air, wherein said mixed air can exit said second channel of the at least two roofing articles through said outlet port.

30. The roofing system of any of embodiments 25-29, wherein each of the at least two roofing articles further comprises a third channel defined in a lower portion of said body, wherein a second sheet separates said third channel from said second channel.

31. The roofing article of any of embodiments 25-30, further comprising an airflow interrupter presented with said airflow path for at least partially closing at least one of said first channel or said second channel when said airflow interrupter is exposed to temperatures at or greater than about 350 degrees Fahrenheit.

32. The roofing article of embodiment 31, wherein said airflow interrupter comprises an intumescent material.

33. A roofing system comprising at least two roofing articles, each roofing article comprising:

a body;

a channel defined in said body, said channel comprising an inlet port and an outlet port; and first and second connection members for interconnecting said at least two roofing articles, such that when said at least two roofing articles using said first and second connection members, the outlet port of one of the at least two roofing articles is substantially aligned with the inlet port of the other of the at least two roofing articles to create an airflow path between the at least two roofing articles.

34. A roofing system of embodiment 33, wherein said first connection member comprises a tab and said second connection member comprises a recess.

35. A roofing system of embodiment 33, further comprising an upper channel defined in said body, said upper channel comprising an outside air inlet through which outside air can enter said upper channel, wherein a sheet separates said channel from said upper channel, said channel being operably connected to said upper channel through an orifice in said sheet such that the outside air can enter said channel through said orifice, This summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

FIG. 11 is a fragmentary cutaway schematic top view of a plurality of roofing articles of FIG. 1, further depicting an air flow pattern.

While the above-identified figures set forth several embodiments of the disclosed subject matter, other embodiments are also contemplated, such as those noted in the disclosure. In all cases, this disclosure presents the disclosed subject matter by way of representation and not by limitation. The figures are schematic representations, for which reason the configuration of the different structures, as well as their relative dimensions, serves illustrative purposes only. Numerous other modifications and embodiments can be devised by those skilled in the art, which other modifications and embodiments fall within the scope and spirit of the principles of this disclosure.

DETAILED DESCRIPTION

When in the following terms such as "upper" and "lower", "top" and "bottom", "right" and "left", or similar relative expressions are used, these terms only refer to the appended figures and not necessarily to an actual situation of use.

The present disclosure broadly relates to a roofing article with an airflow path for use in an above-deck roof ventilation system, and methods of installing such roofing articles. Various exemplary embodiments of the disclosure will now be described with particular reference to the Drawings. Embodiments of the present disclosure may take on various modifications and alterations without departing from the spirit and scope of the disclosure. Accordingly, it is to be understood that the embodiments of the present disclosure are not to be limited to the following described exemplary embodiments, but is to be controlled by the limitations set forth in the claims and any equivalents thereof.

Thus, reference throughout this specification to "one embodiment," "embodiments," "one or more embodiments" or "an embodiment," whether or not including the term "exemplary" preceding the term "embodiment," means that a particular feature, structure, material, or characteristic described in connection with the embodiment is included in at least one embodiment of the exemplary embodiments of the present disclosure. Therefore, the appearances of the phrases such as "in one or more embodiments," "in embodiments," "in one embodiment" or "in an embodiment" in various places throughout this specification are not necessarily referring to the same embodiment of the exemplary embodiments of the present disclosure. Furthermore, the particular features, structures, materials, or characteristics may be combined in any suitable manner in one or more embodiments.

Figure 1:
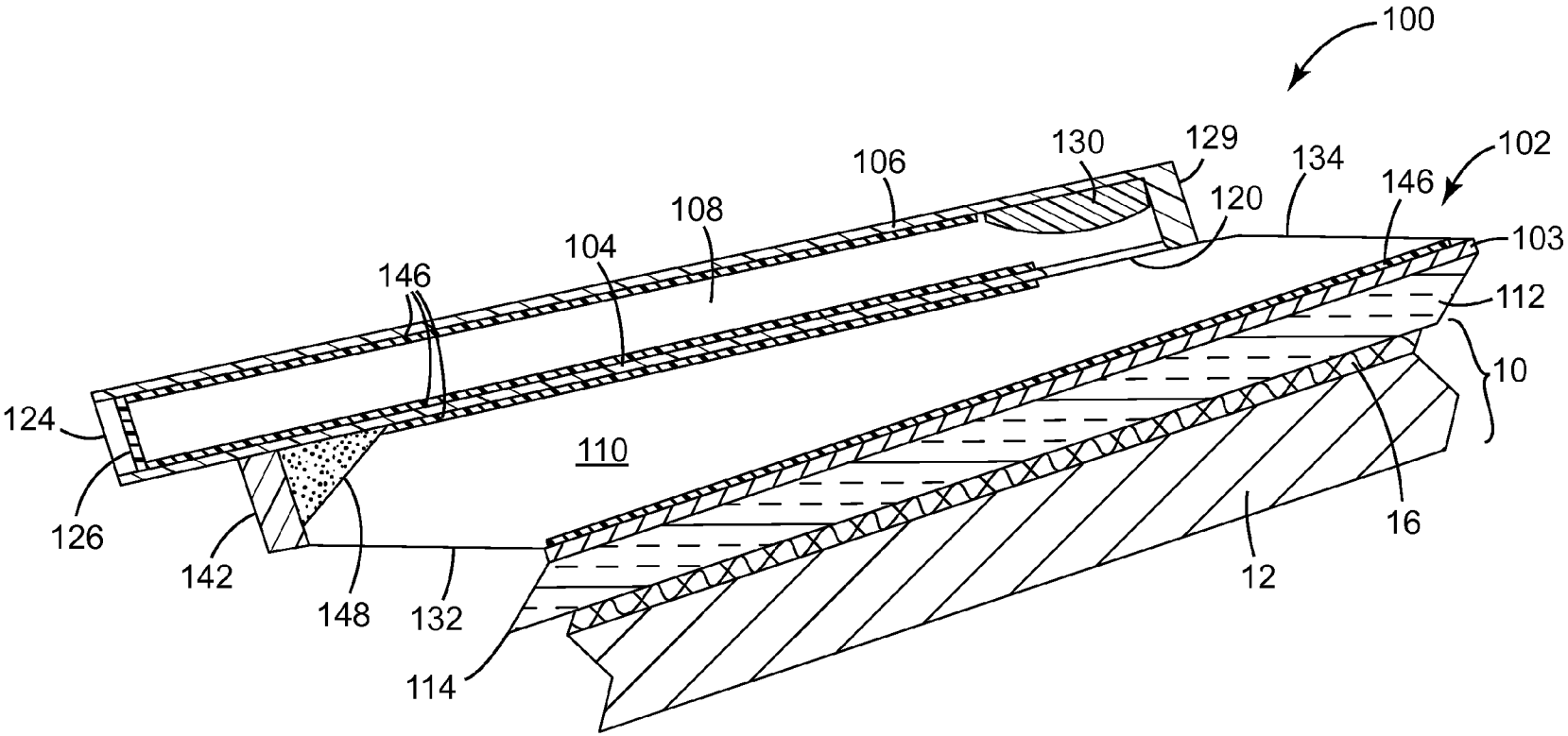
FIG. 1 is a cross-sectional schematic side view of a roofing article according to a first embodiment taken along line 1-1 of FIG. 4.

Referring to FIG. 1, a roofing article according to a first embodiment of the present disclosure can include a body having a base 102 having a bottom sheet 103, a middle sheet 104 overlaying at least a portion of bottom sheet 103, a top sheet 106 overlaying at least a portion of middle sheet 104, and one or more channels presented therein. In embodiments, a first air channel 108 is defined or presented intermediate top sheet 106 and middle sheet 104 and a second air channel 110 is defined or presented intermediate middle sheet 104 and bottom sheet 103. First channel 108 and second channel 110 can be interconnected or otherwise in fluid or airflow communication by an aperture or orifice 120, which is described in further detail below.

Depending on the climate, the roofing articles can be designed so as to ensure or optimize that mixed air stays in the second channel path. This can be done by minimizing the size of the aperture between the first and second channels—so as to increase the resistance through the aperture relative to the resistance of the second channel pathway. Some climates where it can be desirable to ensure or optimize that mixed air stays in the second channel path include colder climates. By retaining the mixed, warmer air in the second channel path, it can help to heat the entire roof and, as a result, melt the snow on the entire roof.

Also, the roofing articles can be designed so as to allow for air to back out of an air inlet included on one of the roofing articles. This can be done by maximizing the size of one or more apertures between the first and second channels—so as to decrease the resistance through the aperture relative to the resistance of the second channel pathway. Some climates where it can be desirable to release air from the second channel path include warmer climates. By enabling air to be released, it can help to keep the roof cooler.

In embodiments wherein it is desired to maintain air flow along an entire length (from bottom to top) of a roof, i.e., so that any air exiting the roofing articles is inhibited, the cross-sectional area of the aperture 120 can be between about 0.05 square inches and about 0.70 square inches (wherein a ratio of the air intake 124 cross-sectional area to the cross-sectional area of the aperture 120 is about 2.0 to about 48.0). Preferably, the cross-sectional area can be between about 0.15 square inches and about 0.35 square inches (wherein a ratio of the cross-sectional area of the air intake 124 to the cross-sectional area of the aperture 120 is about 5.0 to about 16.0). Optimally, the cross-sectional area can be between about 0.15 square inches and about 0.25 square inches (wherein a ratio of the cross-sectional area of the air intake 124 to the cross-sectional area of the aperture 120 is about 8.0 to about 16.0). Such embodiments can be used, for example, in cooler or cold climate zones 4-7.

In embodiments wherein it is desired to vent air flow along one or more points along a length (from bottom to top) of a roof, the cross-sectional area can be between about 0.20 square inches and about 1.25 square inches (wherein a ratio of the air intake 124 cross-sectional area to the cross-sectional area of the aperture 120 is about 1.0 to about 12.0). Preferably, the cross-sectional area can be between about 0.30 square inches and about 0.80 square inches (wherein a ratio of the cross-sectional area of the air intake 124 to the cross-sectional area of the aperture 120 is about 2.0 to about 8.0). Optimally, the cross-sectional area can be between about 0.45 square inches and about 0.70 square inches. Such air flow is described in greater detail below (wherein a ratio of the cross-sectional area of the air intake 124 to the cross-sectional area of the aperture 120 is about 2.0 to about 5.5). Such embodiments can be used, for example, in warm or hot climate zones 1-4.

Figure 4:
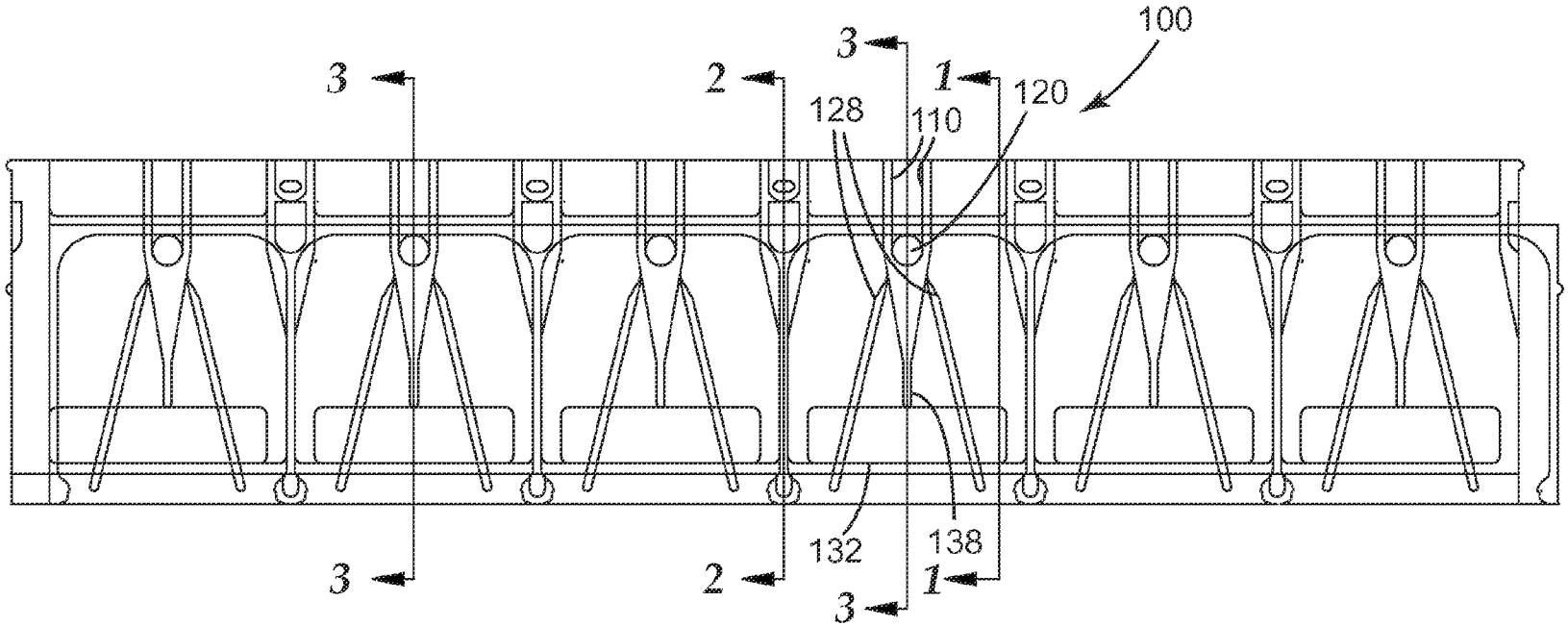
FIG. 4 is a cutaway schematic top view of the roofing article of FIG. 1 in panel form.

Referring to FIG. 4, aperture 120 is depicted as being circular in shape, although other shapes can be used without departing from the spirit and scope of the present disclosure. Bottom sheet 103, middle sheet 104, and top sheet 106 can be formed of various high temperature and fire retardant materials, such as thermoplastic polymers, such as thermoplastic polyolefin, or fluoro or chloro polymers, such as polyvinylidene fluoride, fluorinated ethylene propylene, polytetrafluoroethylene, and polyvinyl chloride using various forming methods, such as, for example, injection molding or thermoforming, although other materials, such as polycarbonate, acrylonitrile butadiene styrene, steel (for example, galvanized), concrete, clay, and treated wood-based products, can be used to form each these components. Other forming methods can include, for example, metal stamping, press forming, pan forming, and various component and piece assembly methods. Additionally, bottom sheet 103, middle sheet 104, and top sheet 106 can be integrally formed or formed separately and then attached, affixed, or otherwise coupled together. Top sheet 106 can include a layer or layers of roofing granules presented thereon, such as, for example, those described in U.S. Pat. Nos. 7,455,899, 7,648,755, and 7,919,170, each of which is incorporated by reference herein in its entirety. Top sheet 106 and/or layer or layers of roofing granules presented thereon can be replaceable, such that this portion can be replaced without the other portions of roofing article 110.

Portions of body, including bottom sheet 103, middle sheet 104, and/or top sheet 106 can be formed using a dark material, such as black, or otherwise coated so as to give a dark appearance. Color, in general, can be defined by "Lab color space or component color" or CIE 1976 (L*, a*, b*), where L* is 0 for black and 100 for white (a is + positive for red and – negative for green, b is + positive for yellow and – negative for blue). This method is a three dimensional way of defining coloring. In general, a "dark" color can be from 0 to about 30 on the L* scale.

Figure 2:
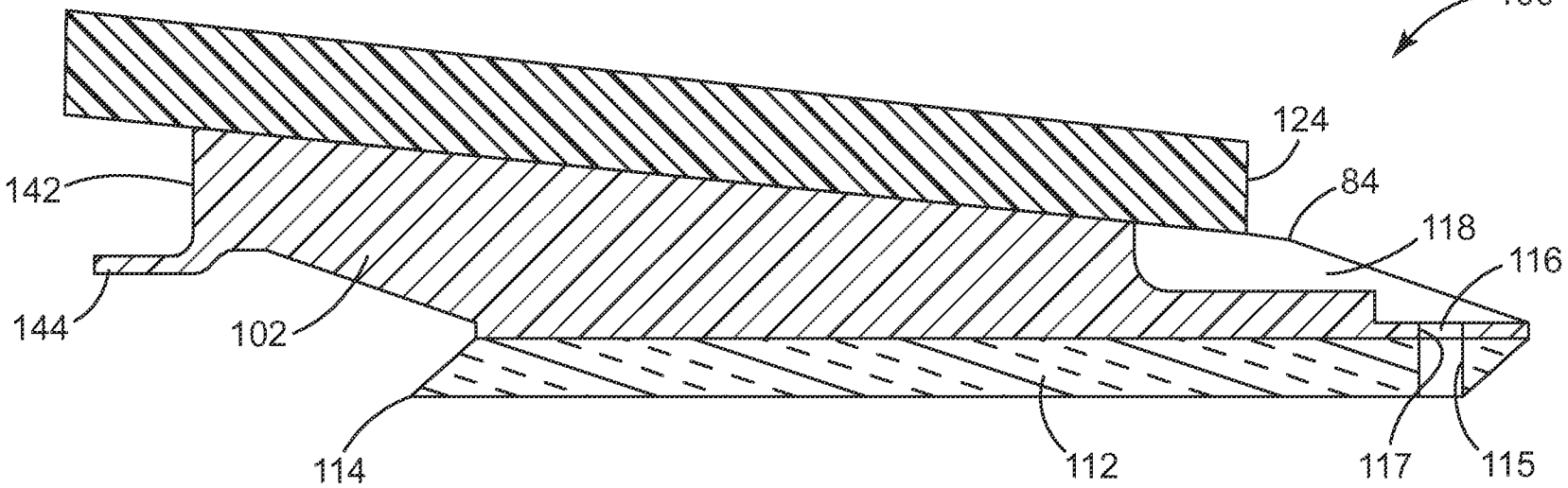
FIG. 2 is a second cross-sectional schematic side view of the roofing article of FIG. 1 taken along line 2-2 of FIG. 4.
Figure 3:
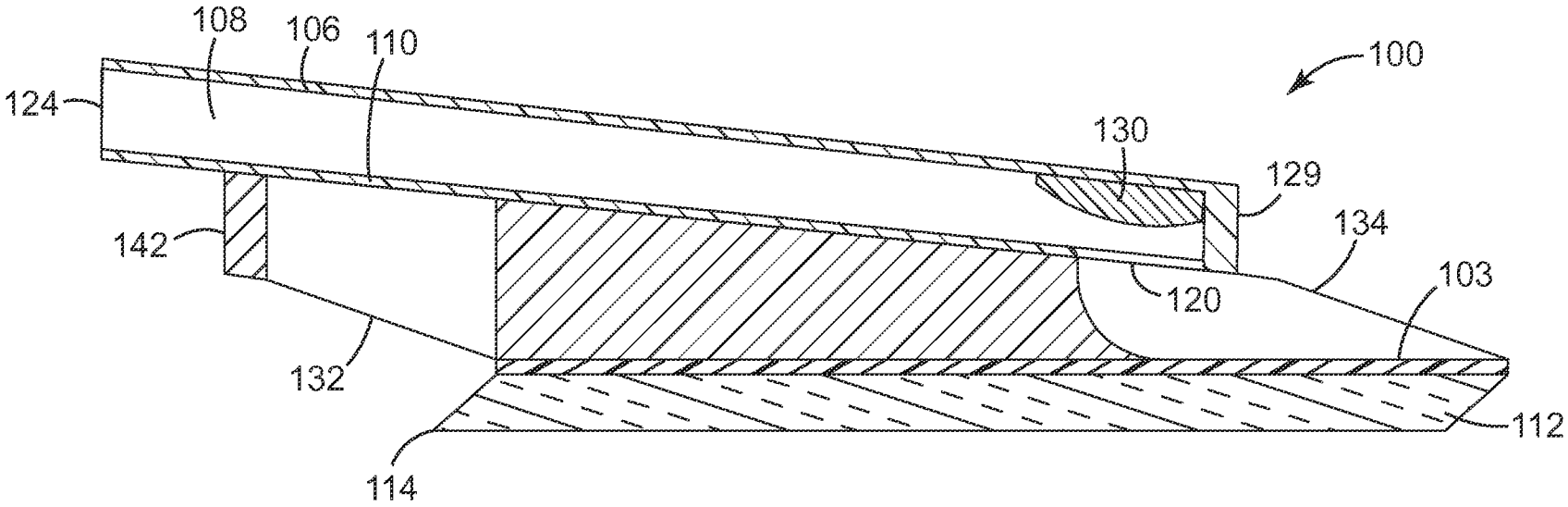
FIG. 3 is a third cross-sectional schematic side view of the roofing article of FIG. 1 taken along line 3-3 of FIG. 4.
Figure 5:
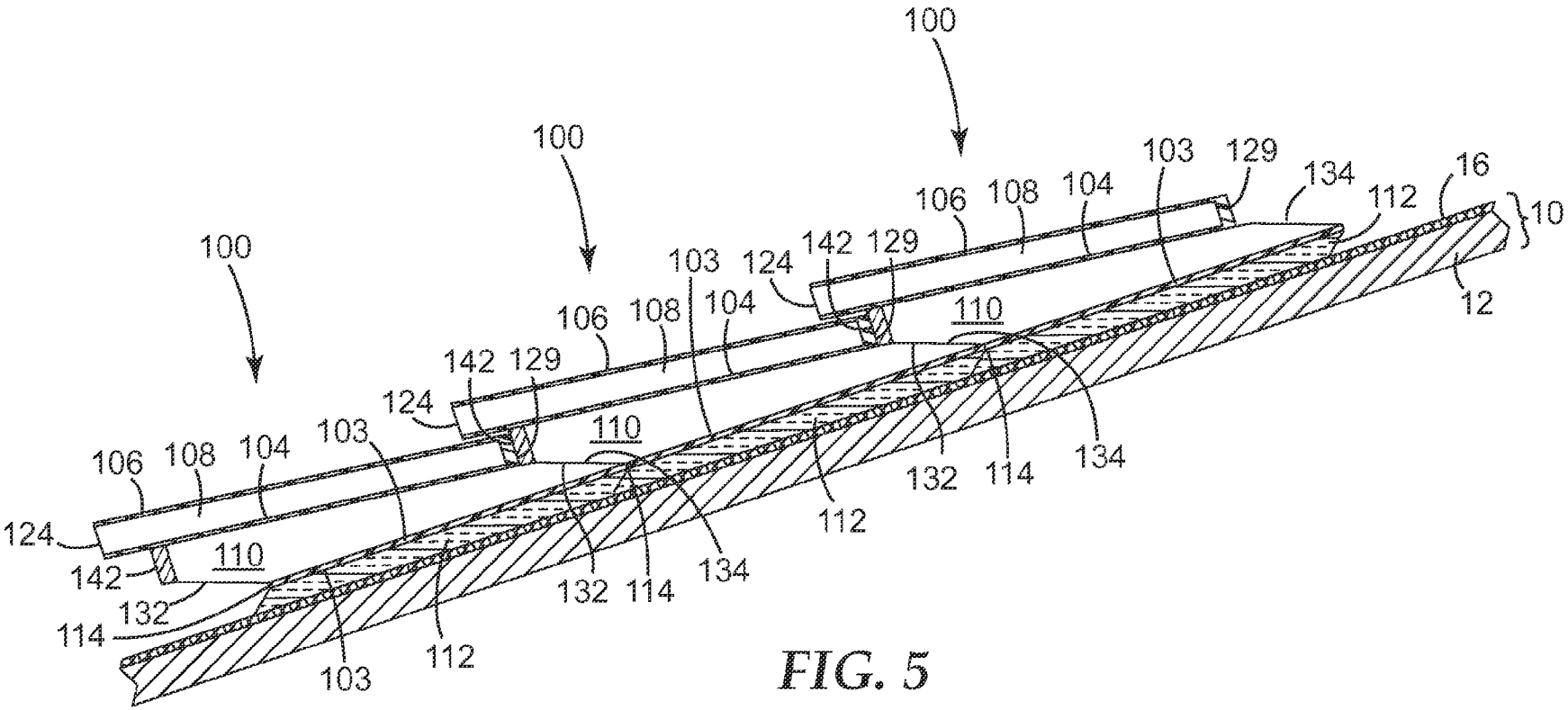
FIG. 5 is a fragmentary cross-sectional schematic side view of a sloped roof having three roofing articles of FIG. 1 thereon.
Figure 6:
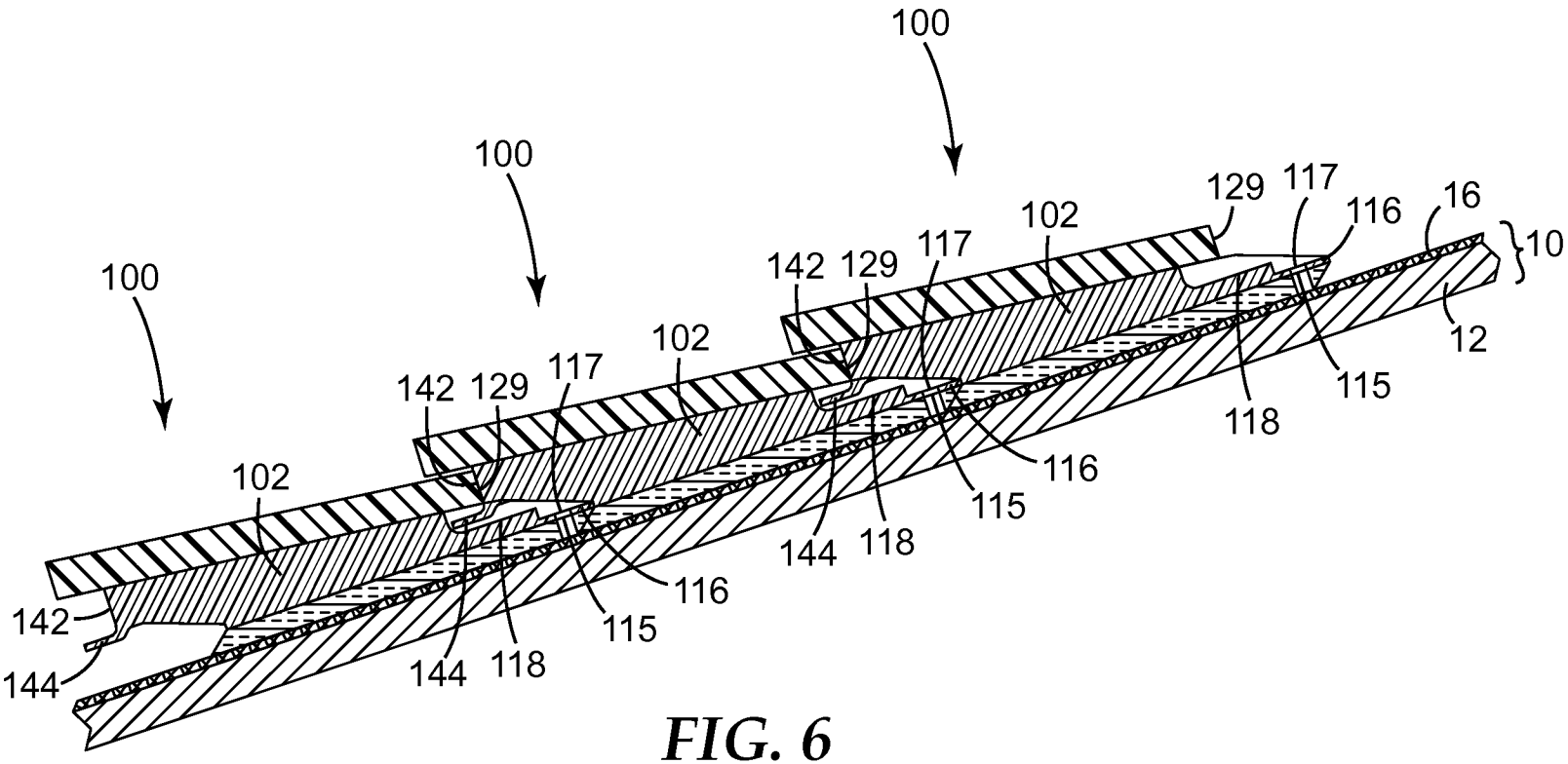
FIG. 6 is a second fragmentary cross-sectional schematic side view of a sloped roof having three roofing articles of FIG. 1 thereon.
Figure 7:
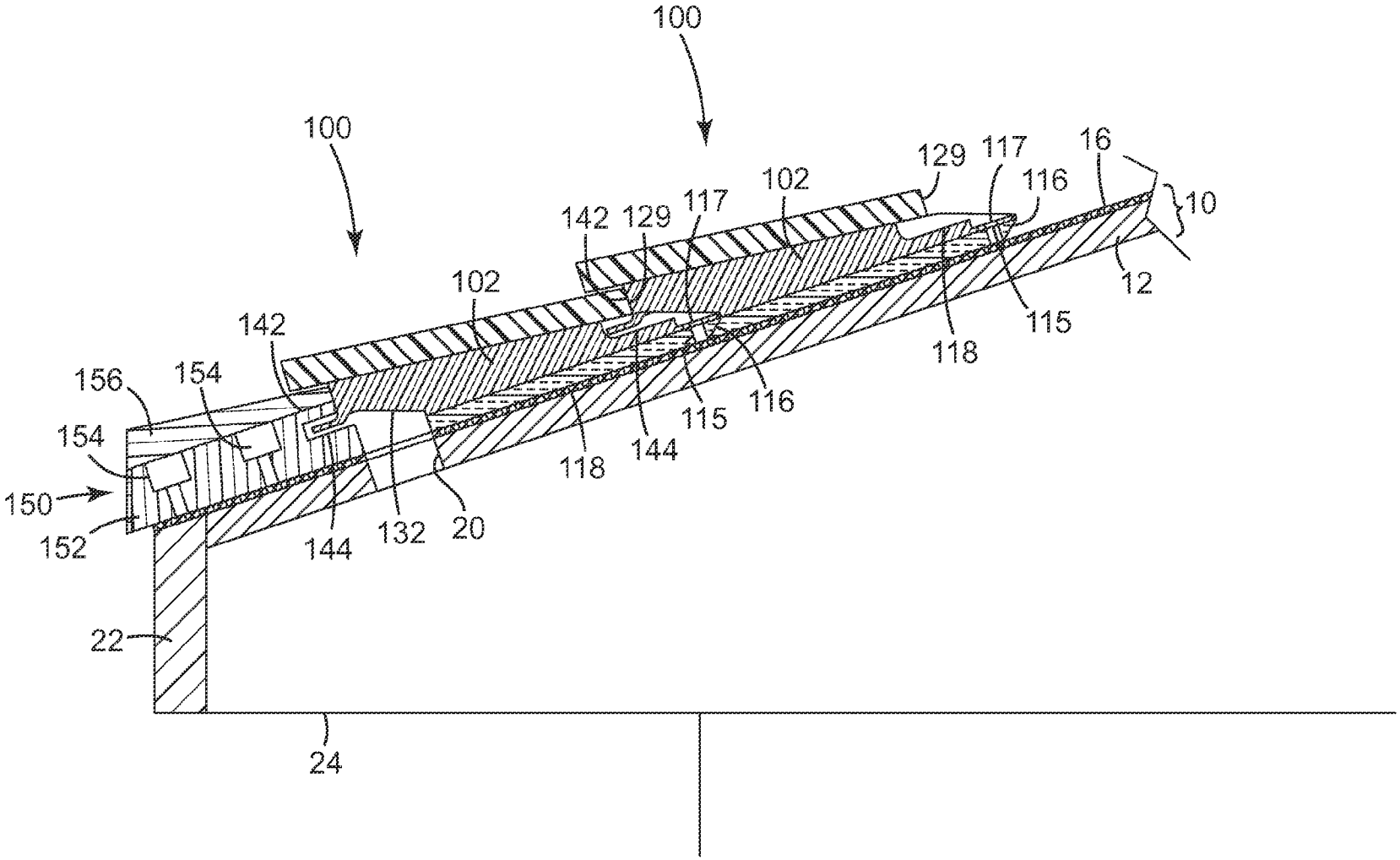
FIG. 7 is a fragmentary cross-sectional schematic side view of a sloped roof having two roofing articles of FIG. 1 thereon taken along line 2-2 of FIG. 4, as well as an installation base or starter unit.

Referring to FIG. 1, a thermal insulation layer 112 can optionally (depending, for example, on climate zone) be included on roofing article, such as on or adjacent to, or incorporated with or adhered to, an underside of bottom sheet 103. Insulation layer 112 can be formed of extruded polystyrene foam (XPS), although other materials, such as expanded polystyrene foam (EPS), polyisocyanurate, polyurethane, or other type of insulation material that has a R value in the range of 2-8 per inch of thickness, can be used. Insulation layer 112 can include a wedge or lock point 114 for use when arranging adjacent roofing articles on a roof deck 12 (see, for example, FIGS. 5-8, 10, and 12) that can function as a primary or secondary locking feature for roofing article. Referring to FIGS. 2, 6, and 7, insulation layer 112 can include one or more mounting apertures 115, such as counter bore recesses, presented thereon or extending therethrough, to aid in fastening or attaching roofing article to roof deck 12.

Referring to FIG. 2, base 102 can include a flange 116 presented along an edge thereof, which flange 116 can include a tab pocket or recess 118 for operably receiving tabs 144 provided on an adjacent roofing article when arranged on a roof deck. A bore 117 that can be included on flange 116 of each roofing article 100 is aligned with bore 115 of insulation layer 112 of each roofing article 100. Tab pocket 118 can have a drainage aperture formed for drainage of moisture from the second channel 110. Such an aperture can comprise a diameter of about 0.125 inches to about 0.155 inches. Tabs 116, and the arrangement of adjacent roofing articles on a roof deck, are described in greater detail below.

Referring to FIG. 1, first channel 108 can comprise an air inlet 124 at a first end thereof. Air inlet 124 can include a cover 126, such as a perforated rigid material with a fire protective type covering , a screen, scrim, nonwoven web, or other structure to inhibit the ingress of snow, insects, birds, small animals, debris, precipitation (e.g., rain, snow, sleet, hail) from entering air inlet 124. Cover is preferably UV stable. In embodiments, cover 126 can be formed with a meltable material, such as a polyester fabric, so as to close the air inlet, and, therefore, any airway path or funnel, such as in the event of a fire. In embodiments, cover 126, such as a screen, can include a copper or zinc strip or other form in the screen, such that copper ions released from the strip can inhibit the growth of algae and other fungus material in cover.

Cover 126 can be integrally formed with top sheet 106 and middle sheet 104 or formed separately and then attached, connected, or otherwise coupled to top sheet 106 and/or middle sheet 104. The first end of first channel 108, including air inlet 124 and cover 126, can comprise a color chosen for aesthetic purposes. As discussed herein, darker colors are oftentimes preferred. This can be accomplished by using a relatively dark color for first end of first channel 108, including air inlet 124 and cover 126, so as to give a roof a darker appearance when viewed by someone standing below the roof deck surface. As can be seen in FIG. 5, when assembled, there are two general exposed surfaces—the top surface of top sheet 106 and the first end of first channel 108, including air inlet 124 and cover 126. When the roof is viewed by someone standing below the roof deck surface, that person largely sees the first end of first channel 108.

Referring to FIG. 1, a rear face 129 can be formed at a second end of first channel 108 and can extend from top sheet 106 to middle sheet 104. As discussed above, an aperture 120 interconnects (or puts into fluid or airflow communication) first channel 108 and second channel 110. Aperture 120 can extend through middle sheet 104 or otherwise be formed along an edge or at an end of middle sheet 104.

Referring to FIGS. 4 and 11, first channel 108 (not numbered in FIGS. 4 and 11) can further include one or more ribs 128 or air guides (two depicted) that can direct free and force convection. The ribs 128 can be arranged in a tapered fashion and can extend between top sheet 106 and middle sheet 104 to provide further structural integrity to roofing article 100. Referring again to FIG. 1, first channel 108 can also include an air director airflow deflection member 130 positioned proximate aperture 120 that can guide or route incoming outside intake airflow down through aperture into second air channel. Airflow deflection member 130 can be formed of various materials, such as, for example, the materials and formation methods described above with respect to bottom sheet 103, middle sheet 104, and top sheet 106, although other materials, such as a plastic-coated intumescent material for fire protection, ceramics, and other non corrosive materials, can be used. Also, airflow deflection member 130 can be integrally formed within first channel 108, such as with top sheet 130. Alternatively, airflow deflection member 130 can be formed separately and then attached, connected, or otherwise coupled within first channel 108, such as with top sheet 130, using, for example, adhesives, snap lock, hook and loop, thermal weld, and other mechanical fasteners. Further, while airflow deflection member 130 is depicted as being shaped as a cutoff sphere, other three-dimensional shapes can be used without departing from the spirit and scope of the present disclosure. In embodiments, a screen made with a meltable material, such as polyester, can be provided over aperture 120 such that, in the event of a fire, the screen would melt and close, at least in part, aperture 120.

Referring to FIG. 1, second channel 110 can include a first, air inlet port 132 along a first edge thereof and a second, air outlet port 134 along a second edge thereof. Referring to FIGS. 4 and 11, second channel 110 can further include an airflow vane 136 presented therein, which can extend between middle sheet 104 and bottom sheet 103 to provide further structural integrity to roofing article 100. Airflow vane 136 can include a head vane member 138 and two tail vane members 140.

Referring to FIGS. 1 and 2, second channel 110 can further include a front face 142 of roofing article 100 and one or more tabs 144 extending from front face 142. Also, in embodiments, second channel 110 can narrow, as measured in an orthogonal direction relative to bottom sheet 103, tapering from being wider at air inlet port 132 to narrower at air outlet port 134.

Referring to FIG. 1, each of first channel 108 and second channel 110 can comprise one or more radiant barrier film layers or low emissivity surface 146. Radiant barrier film layers can be formed of a thin layer of a highly reflective material, such as aluminum, a silver metalized weatherable acrylic film (for example, film commercially available as 3M™ Solar Mirror Film 1100), or of a black body. In embodiments, the emittance of radiant barrier film layers is less than about 0.1 as measured by ASTM C1371. As depicted, first channel 108 includes a radiant barrier film layer 146 on an underside of top sheet 106 and another on an upper side of middle sheet 104. Second channel 110 includes a radiant barrier film layer 146 on an underside of middle sheet 104 and another on an upper side of bottom sheet 103.

Roofing article can further include intumescent material portion 148. Such intumescent material portion 148 can undergo a chemical change when exposed to heat or flames to expand into a heat-insulating form. This enables containment of fire and toxic gases and inhibits flame penetration, heat transfer, and movement of toxic gases. As used throughout this disclosure, "intumescent material" refers to a substance that when applied to or incorporated within a combustible material, reduces or eliminates the tendency of the material to ignite when exposed to heat or flame, and, in general, when exposed to flame, the intumescent substance induces charring and liberates non-combustible gases to form a carbonific foam which protects the matrix, cuts off the oxygen supply, and prevents dripping. Such heat can be at or about 350 degrees Fahrenheit. Intumescent materials can comprise an acid source, a char former, and a blowing agent. Examples of intumescent material include 3M™ Fire Barrier Wrap Ultra GS and REOGARD 1000 from Chemtura (formerly from Great Lakes Chemical Corporation). As depicted, intumescent material is included in second channel 110 proximate air inlet port 132, although such intumescent material portion 148 can be included at several other locations in roofing article 110, such as, for example, proximate to air outlet port 134 or proximate to airflow deflection member 130 or orifice 120, proximate a back of first channel 108, proximate rear face (such as at the radiused back end of 129 in FIG. 4), or proximate cover 126.

Additionally, a phase change material (PCM) can be included at one or more locations in roofing article 110, such as, for example, in insulation 110. Such PCMs can undergo a solid/solid phase transition with the associated absorption and release of large amounts of heat.

Like the intumescent material portion 148, can undergo a change when exposed to heat or flames to expand into a heat-insulating form or shape. Examples of PCMs include those commercial available from PCM Products Limited.

FIG. 5 depicts three roofing articles 100 (cross sections as taken along line 1-1 in FIG. 4) arranged and installed on a roof (on top of roof board 12 and felt 16). In this configuration, rear face 129 of the left-most roofing article 100 is adjacent to and abuts front face 142 of the middle roofing article 100. Outlet port 134 of the left-most roofing article 100 is arranged so as to mate or be generally in alignment with inlet port 132 of the middle roofing article 100. Likewise, the rear face 129 of the middle roofing article 100 is adjacent to and abuts front face 142 of the right-most roofing article 100 and outlet port 134 of the middle roofing article 100 is arranged so as to mate with inlet port 132 of the right-most roofing article 100. This arrangement enables air to flow through and from second channel 110 of the left-most roofing article 100 into and through second channel 110 of the middle roofing article 100 and into and through second channel 110 of the right-most roofing article 100. As will be described in greater detail below, air can also enter the second channel 110 of each of the roofing articles 100 from the first channel 108 of each through each of their respective apertures 120. As can be seen in FIG. 6, insulation layer 112 on each of the roofing articles 100 can include mounting holes 115, such as counter bores, presented thereon or extending therethrough, that can be used for mounting roofing articles 100 to the roof board 12. Additionally, the lock point 114 on insulation layer 112 of each of roofing articles 100 can be used to mate adjacent roofing articles 100 (middle and right-most roofing articles each have a lock point 114 mating with insulation 112 on adjacent roofing article 100).

FIG. 6 also depicts three roofing articles 100 (cross sections as taken along line 2-2 in FIG. 4) arranged and installed on a roof (on top of roof board 12 and felt 16). In this configuration, tab 144 of the middle roofing article 100 is positioned and received within tab pocket 118 of the left-most roofing article 100. Likewise, in this configuration, tab 144 of the right-most roofing article 100 is positioned and received within tab pocket 118 of the middle roofing article 100. Again, lock point 114 on insulation layer 112 of each of roofing articles 100 can be used to mate adjacent roofing articles 100 (middle and right-most roofing articles each have a lock point 114 mating with insulation 112 on adjacent roofing article 100).

Referring to FIG. 7, an installation base or starter unit 150 can be included and used as a base upon which a series of roofing articles 100 are assembled in a serial fashion (two roofing articles 100 depicted in FIG. 7—cross sections as taken along line 2-2 in FIG. 4). Starter unit includes a lower portion 152 having one or more mounting apertures 154, such as counter bores, and a cap 156. Lower portion 152 can further include a tab slot 155. Lower portion 152 of starter unit 150 can be operably coupled to roof (as depicted, on felt 16 and roof board 12) using any of a number of mechanical fastening structures, such as bolts, screws, or nails. Once in place, a tab 144 of a roofing article 100 can be positioned in tab slot 155. Subsequent roofing articles 100 can then be positioned such that their tabs 144 are in tab pockets 118 of lower, adjacent roofing articles 100. In this arrangement, an aperture 20 in roof board 12 can be aligned with inlet port 132 on roofing article 100 enabling attic space air to flow out of the attic or unconditioned space and into second channel 110 of roofing article 100 (not depicted in FIG. 6) and up through and out of a ridge vent 26 (depicted in FIG. 8).

Figure 8:
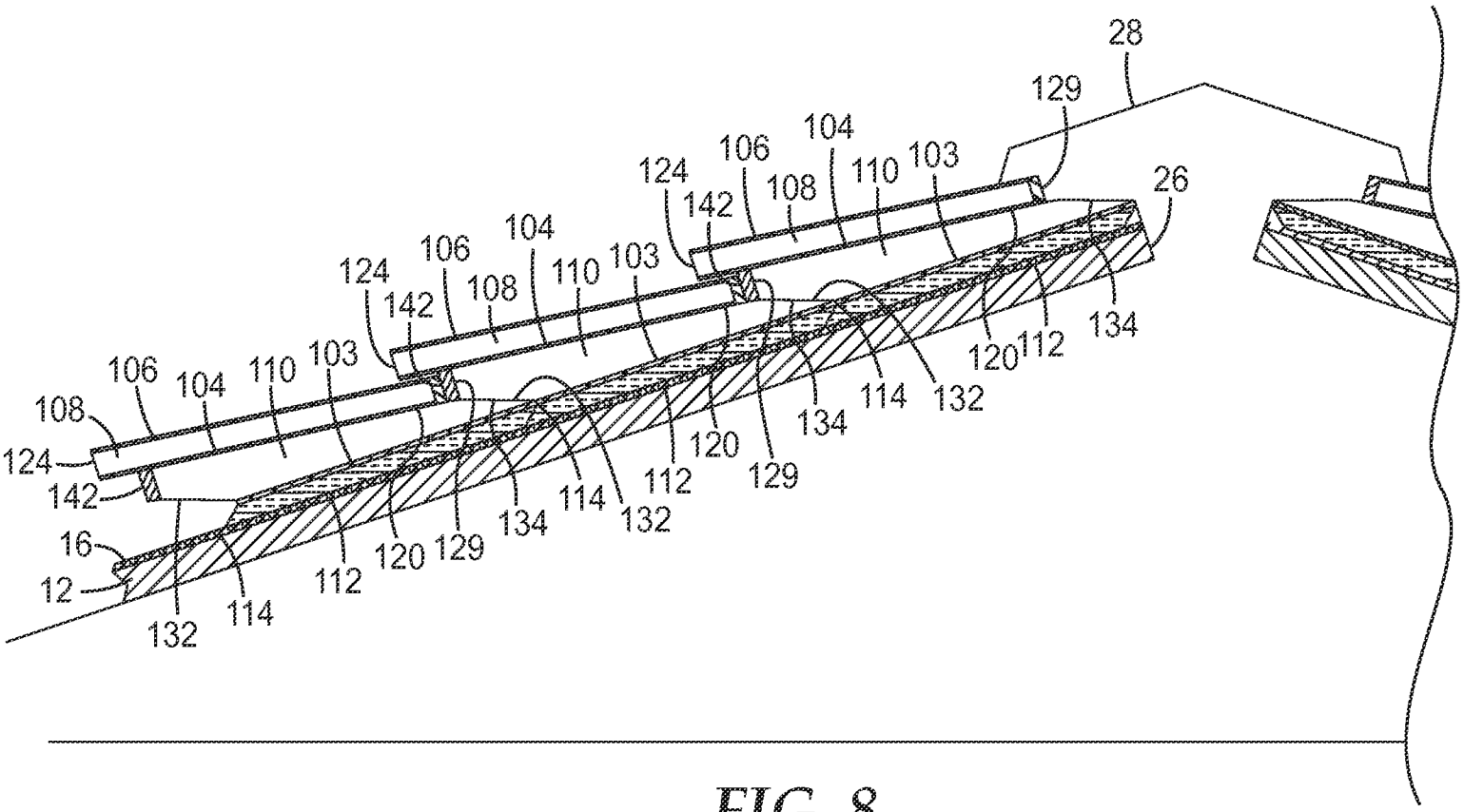
FIG. 8 is a fragmentary cross-sectional schematic view of a sloped roof having three roofing articles of FIG. 1 assembled thereon taken along line 1-1 of FIG. 4, as well as a ridge vent and cap.

Referring to FIG. 8, ridge vent 26 and a ridge cap 28 are depicted. In this figure, three roofing articles 100 (cross sections as taken along line 1-1 in FIG. 4) are arranged and installed on a sloped roof (on roof board 12 and felt 16). In this configuration, rear face 129 of the left-most roofing article 100 is adjacent to and abuts front face 142 of the middle roofing article 100. Outlet port 134 of the left-most roofing article 100 is arranged so as to mate and be in general alignment with inlet port 132 of the middle roofing article 100. Likewise, rear face 129 of the middle roofing article 100 is adjacent to and abuts front face 142 of the right-most roofing article 100 and outlet port 134 of the middle roofing article 100 is arranged so as to mate and be in general alignment with inlet port 132 of the right-most roofing article 100. This arrangement enables air to flow from the second channel 110 of the left-most roofing article 100 into and through the second channel 110 of the middle roofing article 100 and into the second channel 110 of the right-most roofing article 100. When the air exits the air outlet 134 of the right-most roofing article 100 and, thus, reaches the top or ridge 26 of the roof, the air will exit the outlet port 134. Such air will then be vented through the vent 26/cap 28.

Figure 9:
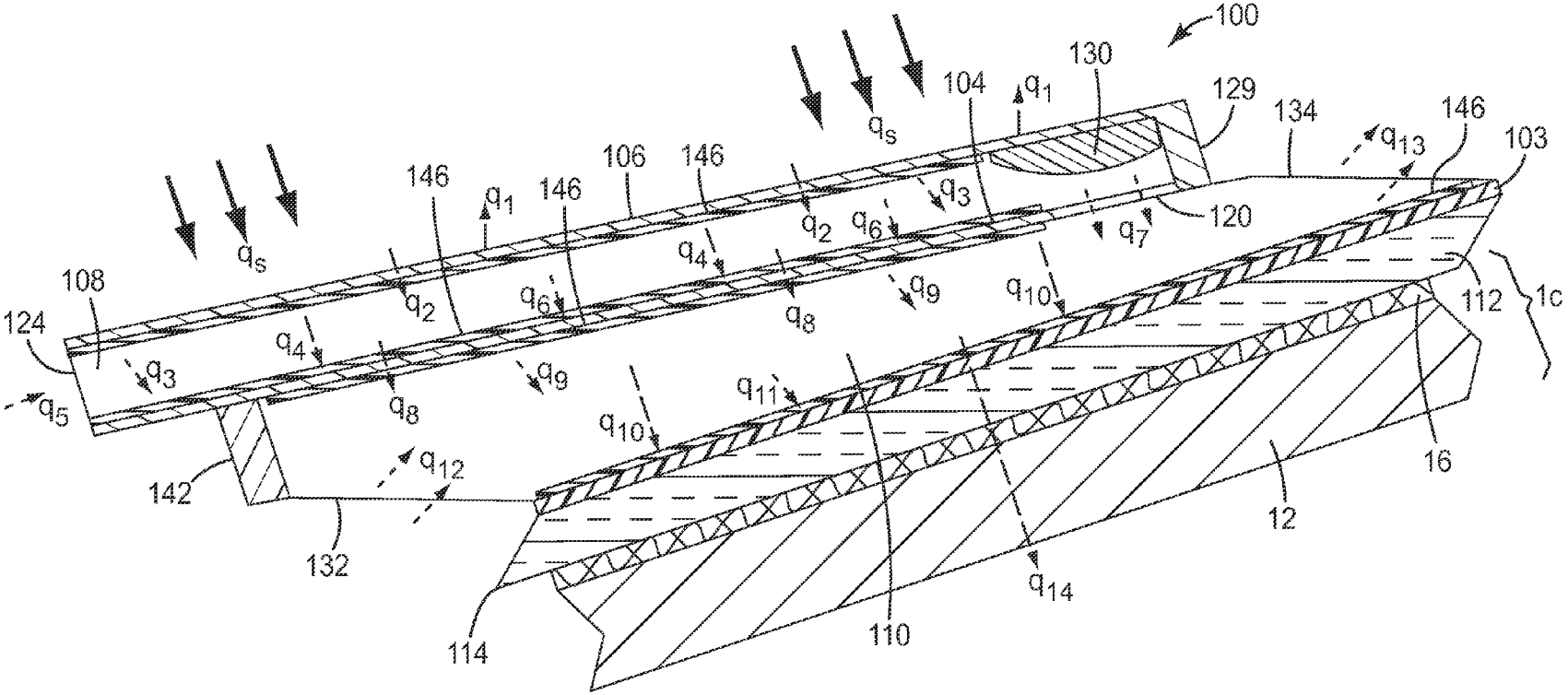
FIG. 9 is a cross-sectional schematic view of the roofing article of FIG. 1 taken along line 1-1 of FIG. 4, further depicting the thermal energy transfer of the roofing article.

FIG. 9 depicts the thermal energy transfer of the roofing article 100 according to the various embodiments herein (first embodiment depicted). Each of the energy components, "q," are as follows:

| Item | Energy Component | Energy Description |
|---|---|---|
| 1 | $q_s$ | Solar and Spectrum Radiation |
| 2 | $q_1$ | Reflective Radiation and Convection |
| 3 | $q_2$ | Conduction Into First Channel |
| 4 | $q_3$ | Free Convection |
| 5 | $q_4$ | Net Radiation of First Channel |
| 6 | $q_5$ | Convection (Free and/or Force) |
| 7 | $q_6$ | Free Convection |
| 8 | $q_7$ | Convection (Free and/or Force) Through Aperture |
| 9 | $q_8$ | Conduction Into Second Channel |
| 10 | $q_9$ | Free Convection |
| 11 | $q_{10}$ | Net Radiation of Second Channel |
| 12 | $q_{11}$ | Free Convection |
| 13 | $q_{12}$ | Convection (Free and/or Force) |
| 14 | $q_{13}$ | Convection (Free and/or Force) |
| 15 | $q_{14}$ | Conduction Through Roof Deck Into Attic Space |

The energy balance equation is as follows:

$$q_s-q_1-q_2-q_3-q_4+q_5-q_6-q_7-q_8-q_9-q_{10}-q_{11}+q_{12}-q_{13}-q_{14}=0$$

Referring to FIG. 9, $q_s$ represents the solar energy from the sun. Of this energy, some of the energy ($q_2$) is transferred by conduction into first channel 108 and some of the energy ($q_1$) is transferred, by reflection and convection, back into the atmosphere. Additional energy may enter roofing article 100 through air inlet 124 ($q_5$) due to free and/or force convection. Of the energy that is in first channel 108, some may move due to free convection ($q_3$ and $q_6$), i.e., flow driven by the presence of a temperature gradient and/or density differences. The net radiation in first channel is transported as $q_4$. Of this, some is transferred by conduction into second channel 110 ($q_8$) and some by free and/or force through aperture 120. Additional energy may enter second channel 110 through inlet port 142 ($q_{12}$) due to free and/or force convection. Of the energy that is in second channel 108, some may move due to free convection ($q_9$ and $q_{11}$). The net radiation in second channel is transported as $q_{10}$. Of this, most is transferred by conduction out of outlet port 134 ($q_{13}$) (to an adjacent roofing article or up and out of a ridge vent). The remainder ($q_{14}$) may be is transferred by conduction into an attic or unconditioned space.

Figure 10:
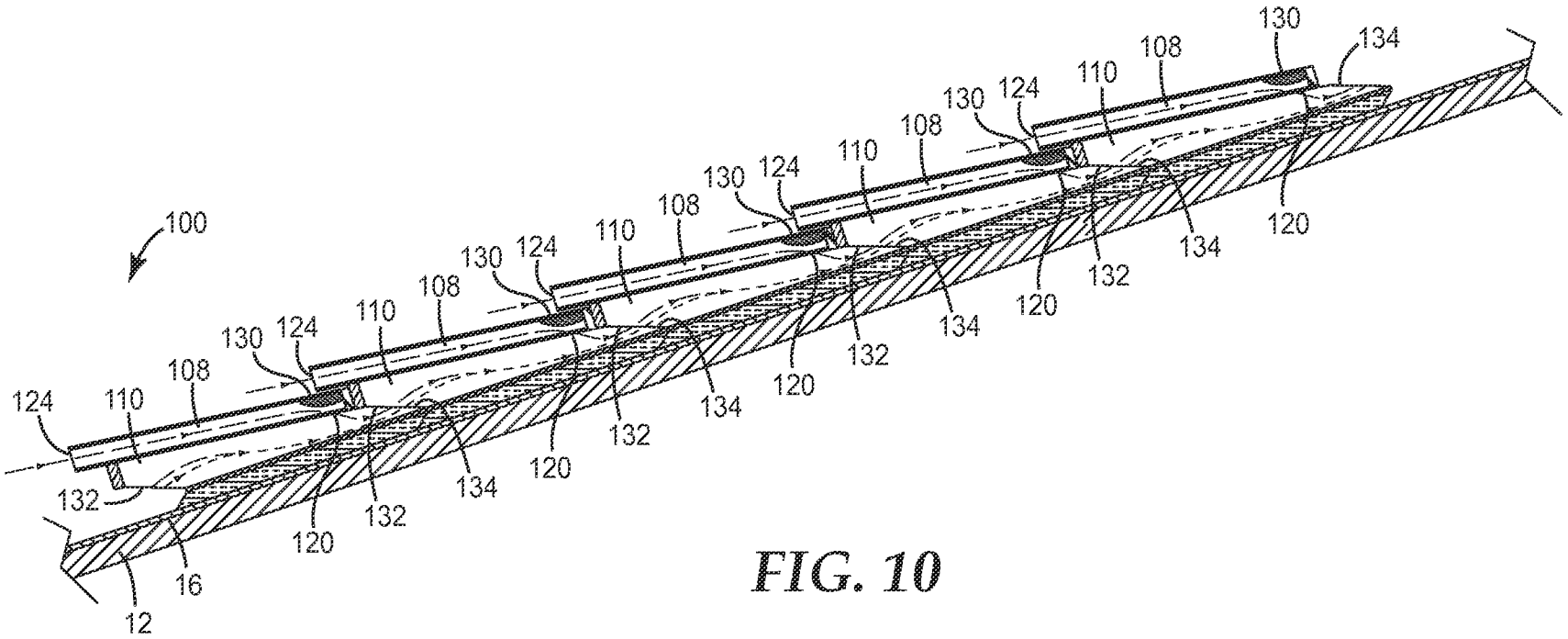
FIG. 10 is a fragmentary cross-sectional schematic view of a sloped roof having five roofing articles of FIG. 1 thereon taken along line 1-1 of FIG. 4, further depicting an air flow pattern.

FIG. 10 depicts air flow through a series of roofing articles 100. Air is depicted as entering the left-most roofing article 100 in two ways. First, outside air enters air inlet 124 and moves upwardly in first channel 108 towards aperture 120. When this air encounters airflow director 130, airflow director 130 directs or routes air downwardly through aperture 120 into second channel 110. Air can also enter left-most roofing article through inlet port 132 (which can come from attic or unconditioned space, such as through a starter unit 150, as depicted in FIG. 7). This air mixes with the air that has been directed into second channel through aperture 120. This mixed air then travels upwardly along the series of roofing articles 100 in their respective second channels 110 until the final, uppermost roofing article 100. At this point, air exits outlet port 134 of the right-most roofing article (to an adjacent roofing article or up and out of a ridge vent). In each of the roofing articles, air that enters air inlet 124 and then routed downwardly through aperture 120 into second channel 110 is mixed with the air traveling travels upwardly along the series of roofing articles 100 in their respective second channels.

FIG. 11 depicts the airflow mechanism through roofing articles in another view (top plan cutaway schematic view). Outside air (depicted in long broken lines) enters roofing article 100 though air inlet 124. This air either travels between or around ribs 128 towards aperture 120. Airflow director (not depicted in FIG. 11) directs or routes air downwardly through aperture 120 into second channel. This outside air can mix with the air flow of second channel 110 (now depicted in solid lines). The mixed airflow travels though second channel and is directed around airflow vane 136—specifically on either side of head vane member 138 of airflow vane 136. Eventually, additional air is directed into second channel through apertures on subsequent, adjacent roofing articles and is mixed with this air to create channel mixed air (depicted in short broken lines).

Figure 12:
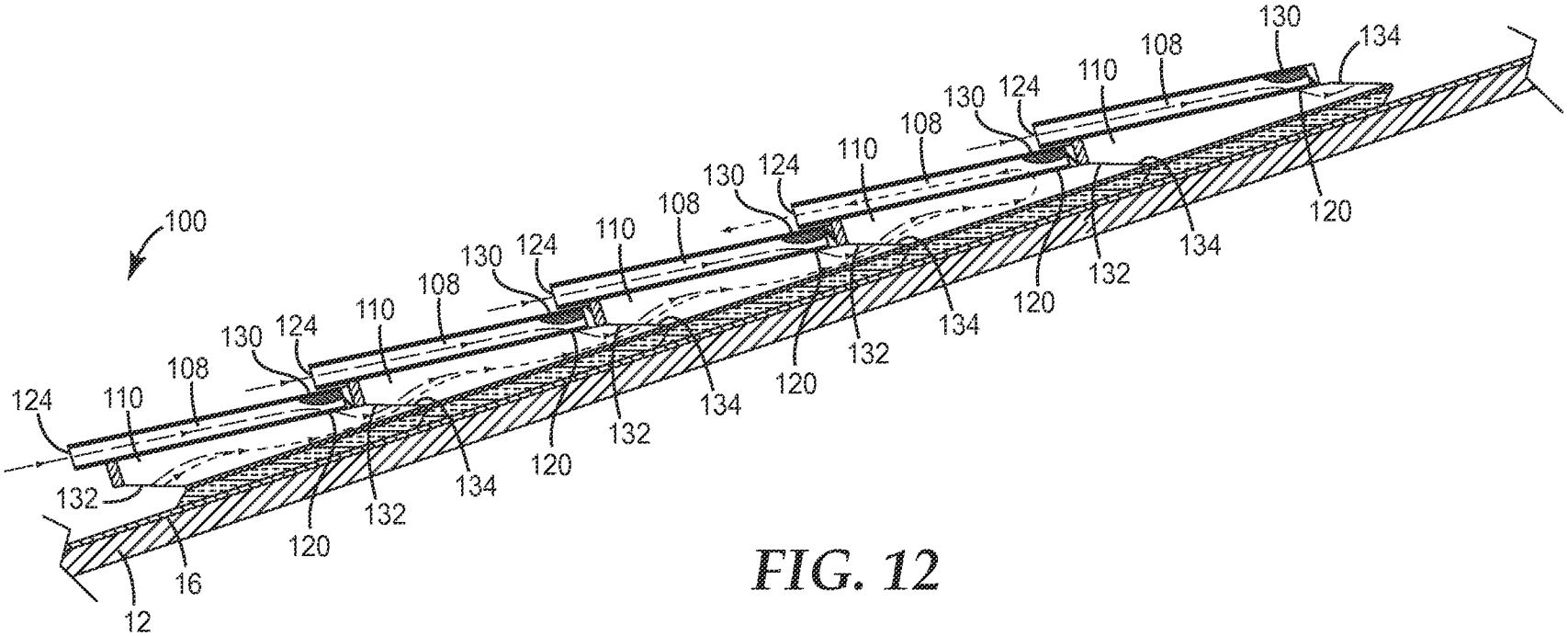
FIG. 12 is a fragmentary cross-sectional schematic view of a sloped roof having five roofing articles of FIG. 1 thereon taken along line 1-1 of FIG. 4, further depicting another air flow pattern.

FIG. 12 also depicts air flow through a series of roofing articles 100, but in an alternative fashion wherein some air backs out of an air inlet 124 of one of the roofing articles 100. As above, air is depicted as entering the left-most roofing article 100 in two ways. First, outside air enters air inlet 124 and moves upwardly in first channel 108 towards aperture 120. When this air encounters airflow director 130, airflow director 130 directs or routes air downwardly through aperture 120 into second channel 110. Air can also enter left-most roofing article through inlet port 132 (which can come from attic or unconditioned space, such as through a starter unit 150, as depicted in FIG. 7). This air mixes with the air that has been directed into second channel through aperture 120. This mixed air then travels upwardly along the series of roofing articles 100 in their respective second channels 110. When the resistance to this mixed air continuing through the second channel 110 path becomes greater than of natural buoyancy, the mixed air flow will find the path to less resistance and begin flowing back out of aperture 120 between the second channel 110 and first channel 108 (i.e., the resistance against the incoming outside air in first channel 108 is less than that of continuing up second channel 110 path), the air will take the path of least resistance and back out of that first channel 108 and air inlet 124. As depicted in FIG. 12, this occurs on the forth roofing article 100 from the left (or second roofing article 100 from the right). Factors that can affect whether the mixed air will continue to travel in the second channel path or back out of the air inlet include the size of the orifices, wind, barometric pressure, and the resistance of the fluid (air) inside second channel 110. For example, if the cross sectional area is increased and the bend/turns are minimized, the air flow will have or meet less resistance as the fluid travels up second channel 110.

As described above, depending on the climate, the roofing articles 100 can be designed so as to ensure or optimize that mixed air stays in the second channel 110 path. This can be done by minimizing the size of aperture 120 between the first channel 108 and second channel 110—so as to increase the resistance through the aperture 120 relative to the resistance of the second channel 110 pathway. Some climates where it can be desirable to ensure or optimize that mixed air stays in the second channel 110 path include colder climates. By retaining the mixed, warmer air in the second channel 110 path, it can help to heat the entire roof and, as a result, melt the snow on the entire roof.

Also, the roofing articles can be designed so as to allow for air to back out of an air inlet 124 included on one or more of the roofing articles 100. This can be done by maximizing the size of one or more apertures 120 between first channel 108 and second channel 110—so as to decrease the resistance through aperture 120 relative to the resistance of the second channel 110 pathway. Some climates where it can be desirable to release air from the second channel path include warmer climates. By enabling air to be released, it can help to keep the roof cooler.

Figure 13:
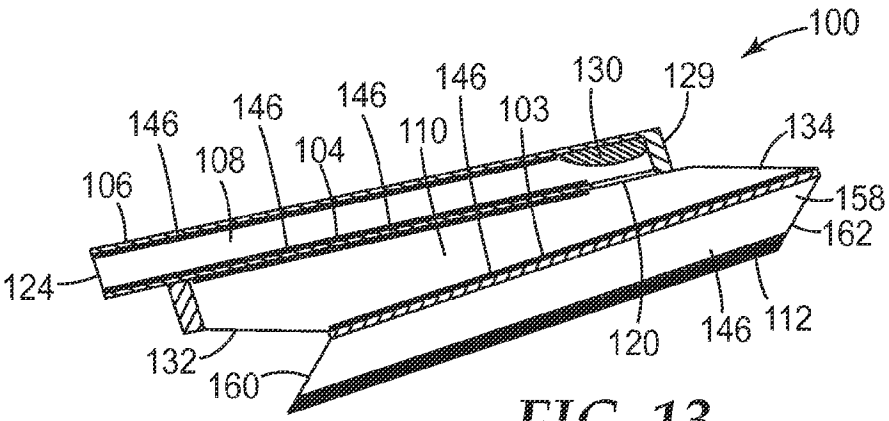
FIG. 13 is a cross-sectional schematic view of a roofing article according to a second embodiment.
Figure 14:
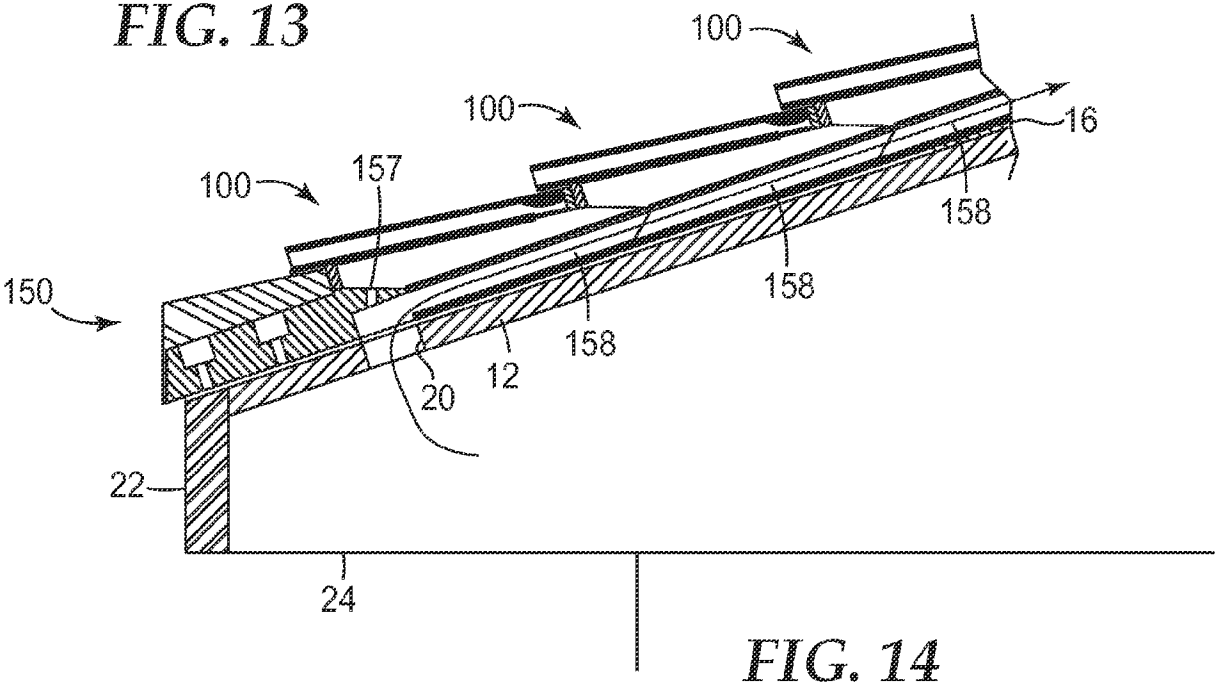
FIG. 14 is a fragmentary cross-sectional schematic view of a sloped roof having two roofing articles of FIG. 13 assembled thereon, as well as an installation base or starter unit.

Referring to FIGS. 13 and 14, another embodiment of roofing article 100 is depicted. In this embodiment, a third channel 158 is included intermediate bottom sheet 103 and insulation layer 112. Third channel 158 can include one or more radiant barrier film layers 146 therein. This embodiment can be useful in climates, such as cold climates, wherein it is desirable to ensure or optimize that mixed air stays in the roofing article (the third channel 158 path). By retaining the mixed, warmer air in the third channel 158 path, it can help to heat the entire roof and, as a result, melt the snow on the entire roof.

When roofing articles 100 of this embodiment are arranged in serial fashion on a roof, third channels 158 on adjacent roofing articles are generally aligned so as to create a third channel 158 path that can extend from an aperture 20 included on roof deck 12 up, along third channels 158 of roofing articles 100, to an exit point, such as a ridge vent (not depicted in FIG. 14). An aperture 157 can be included on starter unit 150 that extends between third channel 158 path and into second channel 110 of the left-most roofing article 100. This enables some venting of the attic space air into the second channel 110 path to form a vacuum and can assist with the air movement within the second channel 110 path. For example, if the temperature delta of third channel 158 is low and reducing the effects of natural buoyancy, aperture 157 will enable air flow from the unconditioned space. This embodiment having third channel 158 can be useful, for example, in colder climates where it can be desirable to retain the mixed, warmer air in the roofing articles 100 for the entire roof, so as to heat the roof and, as a result, melt the snow on the entire roof.

Figure 15:
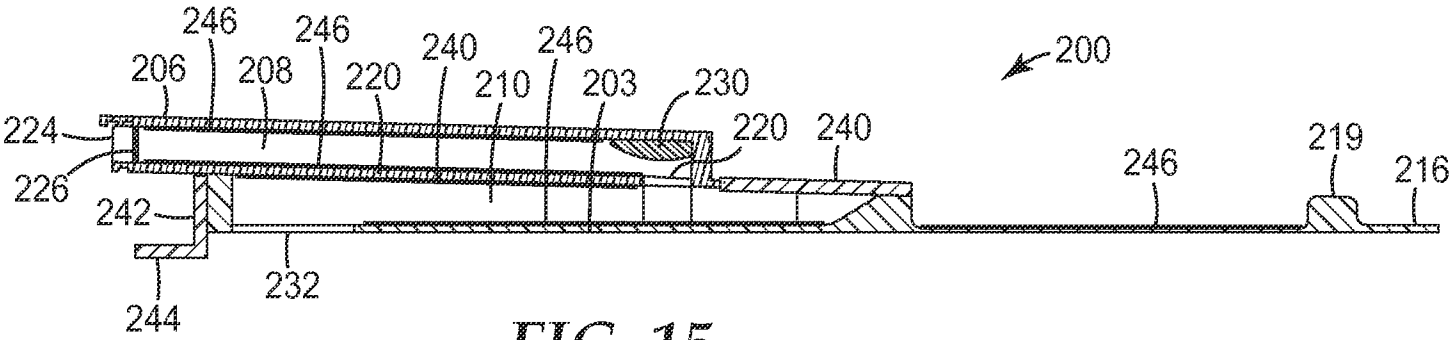
FIG. 15 is a cross-sectional schematic view of a roofing article according to a third embodiment taken along line 15-15 of FIG. 16.
Figure 17:
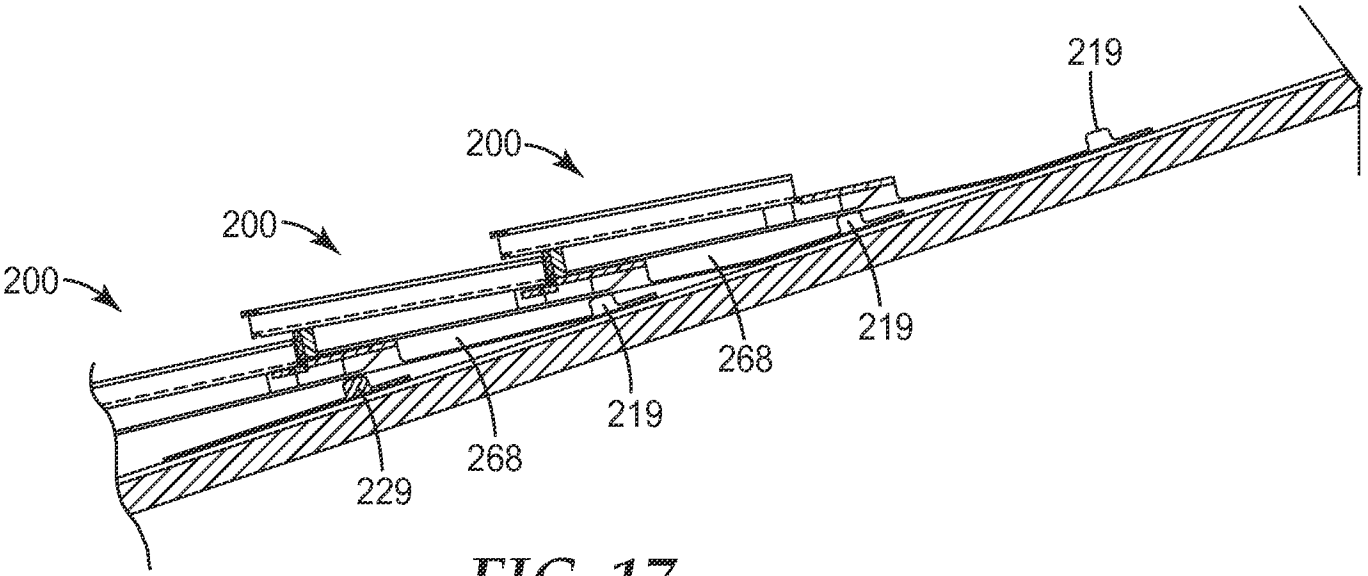
FIG. 17 is a fragmentary cross-sectional schematic view of a sloped roof having three roofing articles of FIG. 15 thereon.
Figure 16:
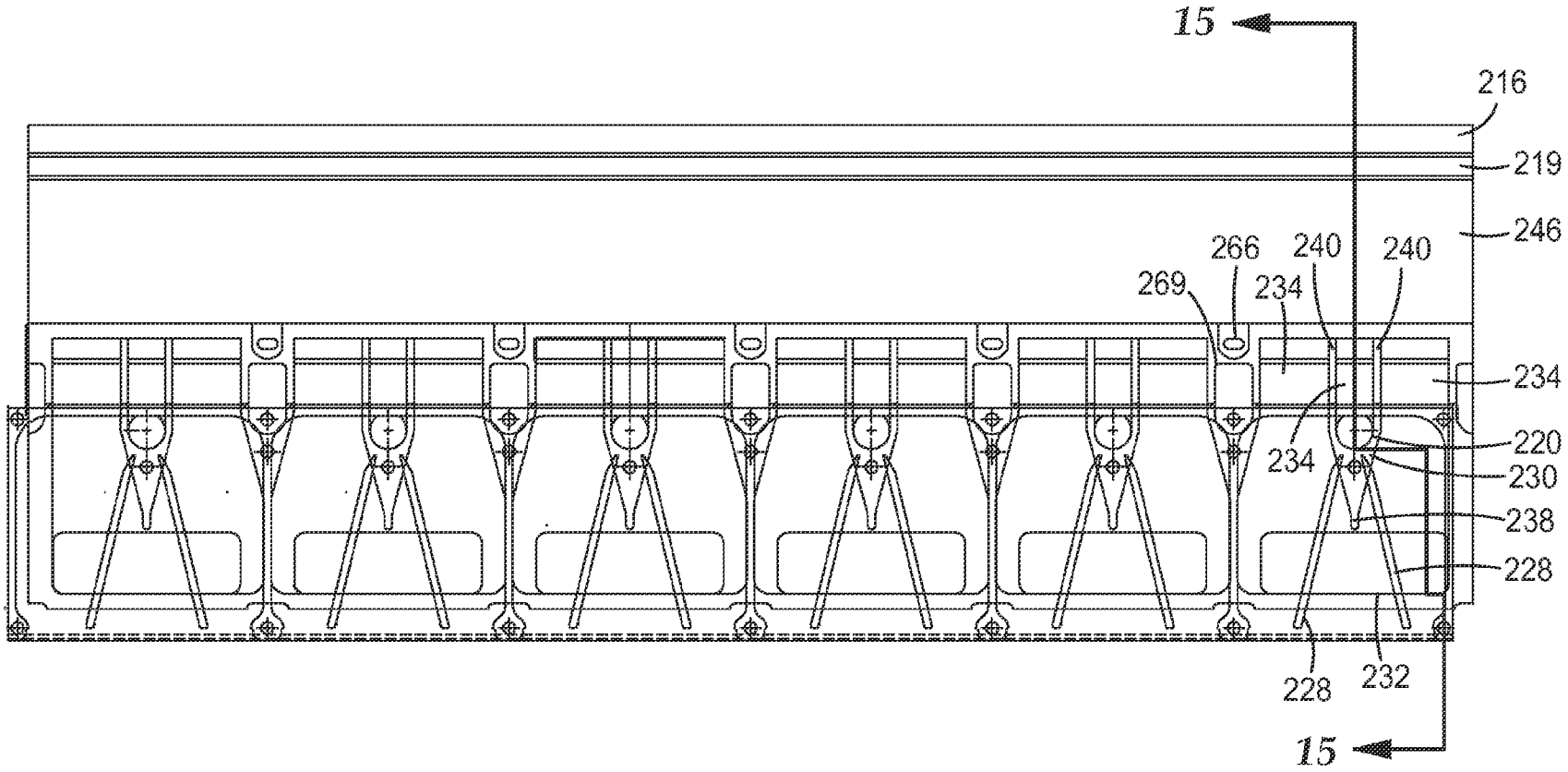
FIG. 16 is a top plan cutaway schematic view of the roofing article of FIG. 15.

Another embodiment of roofing article is depicted in FIGS. 15-17. In this embodiment, a roofing article 200 can include a bottom sheet 203, a middle sheet 204 overlaying at least a portion of bottom sheet 203, and a top sheet 206 overlaying at least a portion of middle sheet 204. A first air channel 208 is defined or presented intermediate top sheet 206 and middle sheet 204 and a second air channel 210 is defined or presented intermediate middle sheet 204 and bottom sheet 203. First channel 208 and second channel 210 can be interconnected or otherwise in fluid or airflow communication by an aperture or orifice 220, the size, shape, and design considerations of which are described in detail above.

Bottom sheet 203, middle sheet 204, and top sheet 206 can be formed of the various materials described above for bottom sheet 103, middle sheet 104, and top sheet 106, although other materials and forming methods can be used to form each these components. Additionally, bottom sheet 203, middle sheet 204, and top sheet 206 can be integrally formed or formed separately and then attached, affixed, or otherwise coupled together. Top sheet 206 can include a layer or layers of roofing granules presented thereon, such as those described in U.S. Pat. Nos. 7,455,899, 7,648,755, and 7,919,170, each of which is incorporated by reference herein in its entirety.

Referring to FIG. 15, bottom sheet 203 can include a flange 216 presented along an edge thereof, which flange 116 can include a ridge 219 thereon, as well as one or more radiant barrier film layers 146. In addition to structure enabling the formation of radiant barrier channel 268, discussed in detail below, ridge 219 can provide further structural integrity to roofing article 200.

Referring to FIG. 15, first channel 208 can comprise an air inlet 224 at a first end thereof. Air inlet 224 can include a cover 226, such as a screen, scrim, nonwoven web, or other structure to inhibit the ingress of snow, insects, birds, small animals, debris, precipitation (e.g., rain, snow, sleet, hail) from entering air inlet 224. Cover 226 can be integrally formed with top sheet 206 and middle sheet 204 or formed separately and then attached, connected, or otherwise coupled to top sheet 206 and/or middle sheet 204. A rear face 229 can be formed at a second end of first channel 208 and can extend from top sheet 206 to middle sheet 204. As discussed above, an aperture 220 interconnects (or puts into fluid or airflow communication) first channel 208 and second channel 210. Aperture 220 can extend through middle sheet 204 or otherwise be formed along an edge or at an end of middle sheet 204. In embodiments, cover 126 can be formed with a meltable material, such as a polyester fabric, so as to close the air inlet, and, therefore, any airway path or funnel, such as in the event of a fire.

Referring to FIG. 16, first channel 208 can further include one or more ribs 228 or air guides (two depicted), which can be arranged in a tapered fashion, and can extend between top sheet 206 and middle sheet 204 to provide further structural integrity to roofing article 200. Referring again to FIG. 15, first channel 208 can also include an airflow deflection member 230 positioned proximate aperture 220 that can guide or route incoming outside intake airflow down through aperture 220 into second air channel 210. Airflow deflection member 230 can be formed of various materials, such as those described above with for airflow deflection member 130, although other materials can be used. Also, airflow deflection member 230 can be integrally formed within first channel 208, such as with top sheet 230. Alternatively, airflow deflection member 230 can be formed separately and then attached, connected, or otherwise coupled within first channel 208, such as with top sheet 230. Further, while airflow deflection member 230 is depicted as being shaped as a cutoff sphere, other three-dimensional shapes can be used without departing from the spirit and scope of the present disclosure.

Referring to FIG. 15, second channel 210 can include a first, air inlet port 232 along a first edge thereof and a second, air outlet port 234 along a second edge thereof (see FIG. 16). Referring to FIG. 16, second channel 210 can further include an airflow vane 236 presented therein, which can extend between middle sheet 204 and bottom sheet 203 to provide further structural integrity to roofing article 200. Airflow vane 236 can include a head vane member 238 and two tail vane members 240. Referring to FIG. 15, second channel 210 can further include a front face 242 of roofing article 200 and one or more tabs 244 extending from or presented on front face 242. Also, in embodiments, second channel 210 can narrow, as measured in an orthogonal direction relative to bottom sheet 203, tapering from being wider at air inlet port 232 to narrower at air outlet port 234.

Referring to FIG. 15, each of first channel 208 and second channel 210 can comprise one or more radiant barrier film layers 246. Radiant barrier film layers can be formed of as described above with respect to 146, although other materials and formation methods can be used. As depicted, first channel 208 includes a radiant barrier film layer 246 on an underside of top sheet 206 and another on an upper side of middle sheet 204. Second channel 210 includes a radiant barrier film layer 246 on an underside of middle sheet 204 and another on an upper side of bottom sheet 203.

Roofing article can further include intumescent material portion. While not depicted, intumescent material is included proximate inlet port 232, although such intumescent material portion 248 can be included at several other locations in roofing article 210, such as, for example, proximate to air outlet port 234 or proximate to airflow deflection member 230 or orifice 220.

FIG. 17 depicts three roofing articles 200 according to embodiments (cross sections as taken along line 15-15 in FIG. 16) arranged and installed on a roof (on top of roof board 12 and felt 10). In this configuration, tab 244 of each roofing article is positioned within a tab pocket 269 (tab pocket 269 not depicted in FIG. 15 of 17, but depicted in FIG. 16). An underside of bottom sheet 103 operably rests adjacent to ridge 219 of an adjacent roofing article, so as to create a radiant barrier zone 268 intermediate adjacent roofing articles. This radiant barrier zone creates a barrier channel that extends in a direction generally orthogonal to the second channel 210 path. The barrier channel can provide an additional mechanism to limit heat transfer to the roof deck, particularly in warm and hot climate zones. Radiant barrier zone 268 can include an insulation material portion presented therein that can be formed of, for example, extruded polystyrene foam (XPS), polystyrene foam (EPS), polyisocyanurate, polyurethane, or other type of insulation material that has a R value in the range of 2-8 per inch of thickness.

Airflow in the embodiment depicted in FIGS. 15-17 is as described with respect to the first embodiment, in particular, as depicted and described with respect to FIGS. 10-12.

Example—

Test Platforms

Two testing platforms (test houses) were built to compare the roofing article according to the present disclosure with asphalt-based roofing shingles. The platforms were designed and built to simulate the attic/conditioned room ceiling construction method/testing platforms at the Oak Ridge National Laboratory. The slopes of the respective roofs of the platforms were south-facing for maximum sun exposure.

The basic size of the platforms was 8' W×12' L with a 4.3' H conditioned room height. The roofs had a 4/12 pitch and a 2' soffit over-hang. The platforms were constructed with 2"×6" stud walls with R-19 rolled insulation and the insulation continued into the attic up the gable side walls. The rear wall (opposite of the roof pitch) also had R-19 insulation installed up to the peak of the roof. The ¾" OSB floor of the test house has R-19 rolled insulation also between the 2"×6" floor joists. There was 1" of exterior plywood on the bottom side of the floor joists. The exterior of the testing platforms had black steel siding as the protective layer.

The ceiling of the conditioned room was constructed with ½" of drywall fastened to the 2"×6" ceiling joists. The 2"×6" ceiling joists were on 16" centers. In between the joists, a 1" XPS (extruded polystyrene) foam layer was positioned and caulked between the wood joists.

The drywall walls in the conditioned space was finished and taped. The conditioned room was cooled (or heated) with a wall mounted unit. The respective room maintained a constant 68° F. and was controlled through a AB 1400 "PLC."

The platform with traditional asphalt-based shingles was built with 2"×6" rafters on 16" centers with ⅝" OSB roof deck with a standard felt layer. The asphalt shingles were nailed to the roof deck. The platform with the roofing articles according to the present disclosure was built with 2"×6" rafters on 16" centers with ⅝" OSB roof deck. The roof deck also had a second deck of 1" of XPS (extruded polystyrene) and ⅝" OSB roof deck with a "water & ice" felt layer. The roofing article (according to the embodiment depicted in FIGS. 15-17) was screwed down to the OSB deck below. Asphalt shingles were nailed to the roof deck.

For data collection, a thermocouple, RTD, and heat flux sensors were positioned in the platforms in the same locations relative to each other. Two (2) RTDs were located on the ceiling (conditioned side) and two (2) RTD's were located at the high point of the attic just under the roof deck board. Heat flux sensors were located on both sides of the attic (conditioned and unconditioned) and various locations on the underside of the roof deck in the attic zone. Thermocouples (Type T's) were located through heat flow zones of the roofing articles.

Figure 18:
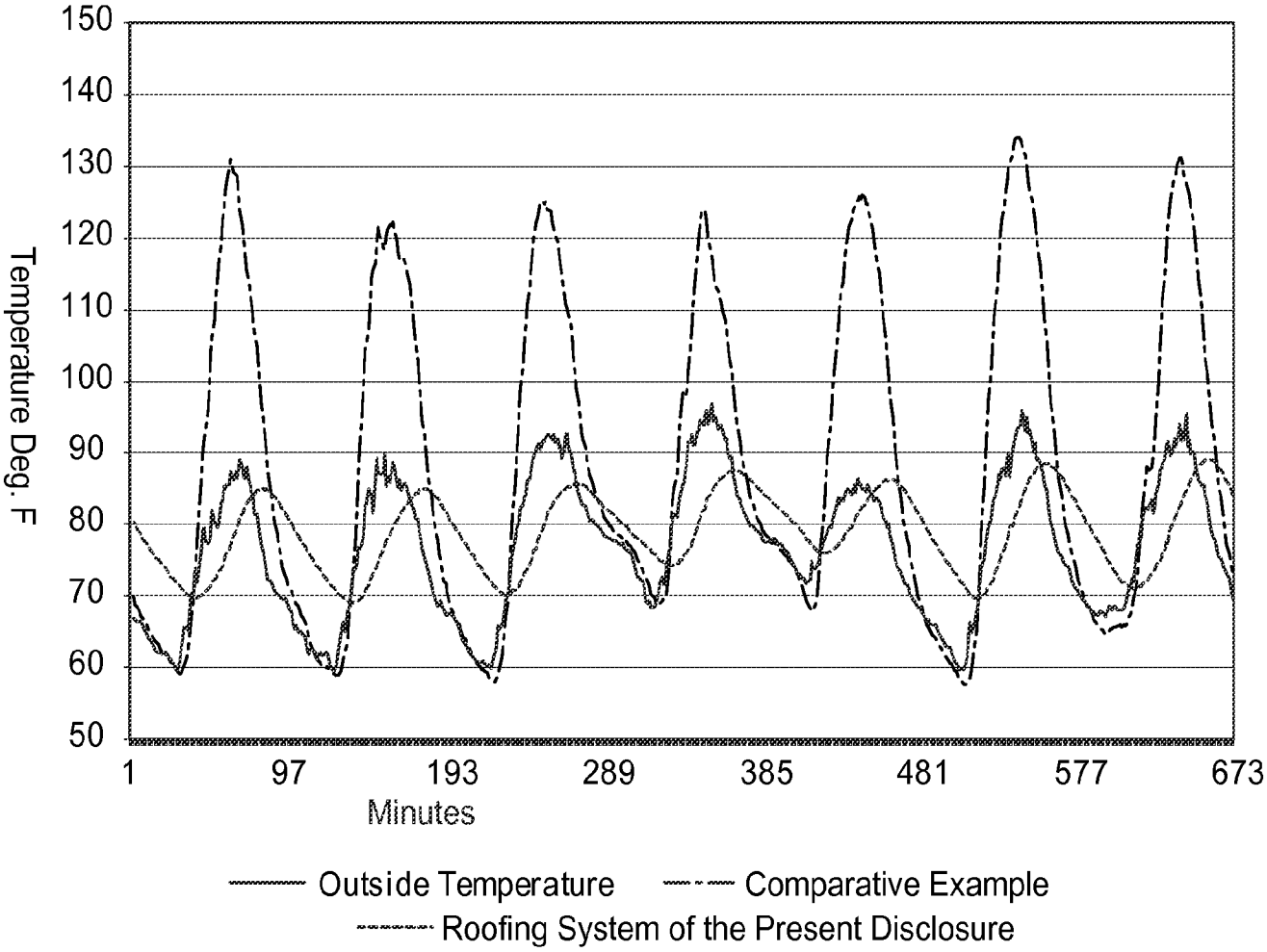
FIG. 18 is a graph of data collected from two test platforms (1) platform with roofing article according to the present disclosure and (2) platform with asphalt-based shingles, as well as the outside temperature.

FIG. 18 is a graph of the data collected from the two test platforms. The data was collected over a seven-day period between Aug. 19, 2011 and Aug. 26, 2011. Data readings were collected every 15 minutes for that period.

Figure 19:
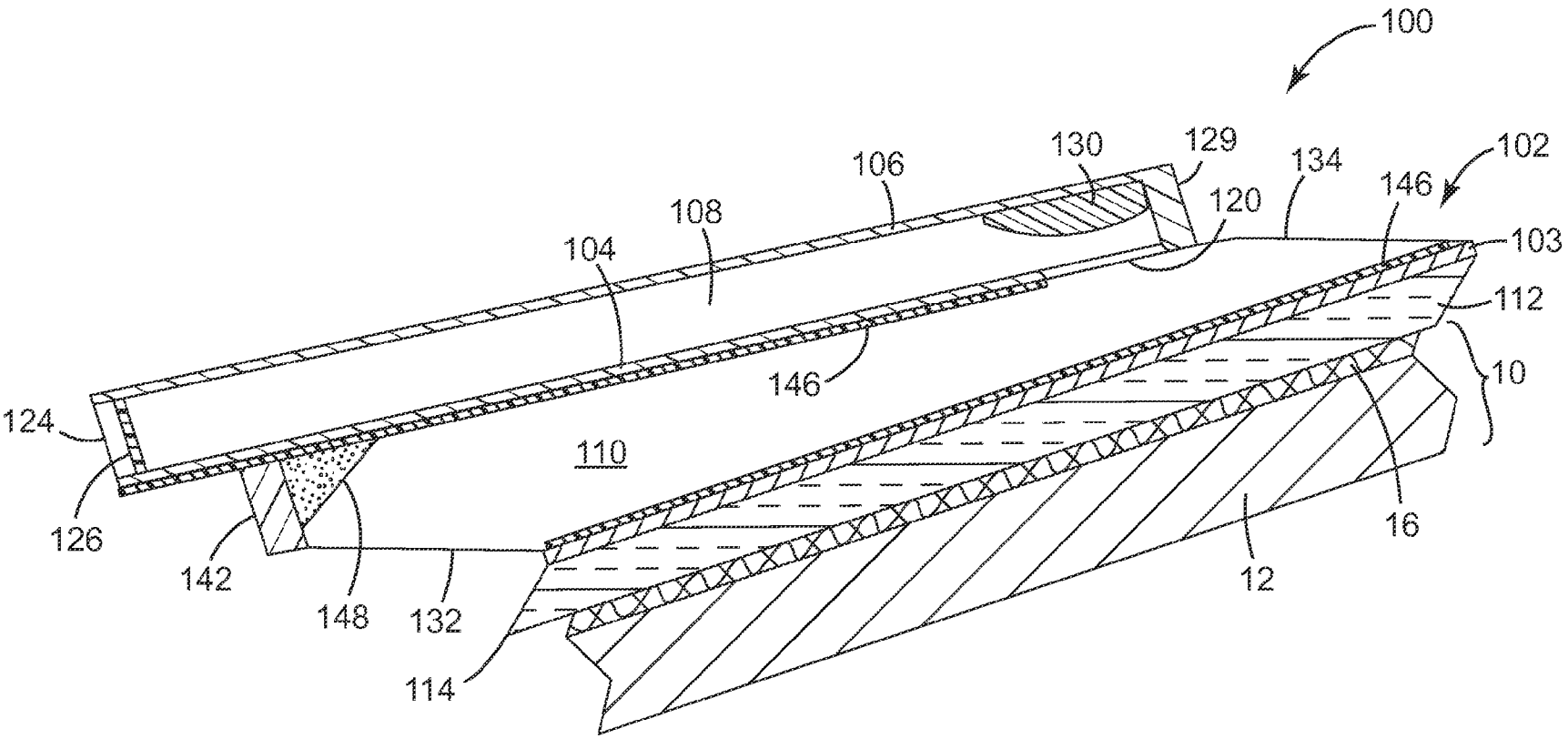
FIG. 19 is a cross-sectional schematic view of a roofing article according to a fourth embodiment.

FIG. 19 depicts a roofing article 100 according to a fourth embodiment. In this embodiment, unlike in the first embodiment, roofing article 100 does not include radiant barriers in the first channel 108. This enables energy to conduct through the top sheet 106 and middle sheet 104 into the second channel 110, without having to go through additional radiant barrier layers, which can enhance the suitability for use as a heat sink, such as for a back plane for photovoltaic modules. Once heat is in second channel 110, radiant barrier layer 146 on the top of second channel 110 will keep it in that channel and inhibit transport of the energy back into first channel 108. The roofing articles according to the other embodiments herein are also suitable for use as back planes for photovoltaic modules.

Installation of the roofing articles on a roof can be as follows for the various embodiments of the present disclosure. While described with respect to the first embodiment, the installation method can be used for any of the various embodiments described herein.

Making reference to FIGS. 1-13, after the roofing felt 16 or another covering material is installed on roof deck 12 and apertures 20 have been cut, starting or base unit 152 can be fastened at or proximate a lower edge proximate soffit 24 of roof deck 12. An adhesive material can be fastened, mechanically or otherwise, on a top of starting or base unit 152. Cap 156 can then be attached to starting or base unit 152.

For a left-handed roofing portion (i.e., sloping from left upwards to right), working from left to right for installation of article 100, a straight edge can be cut on roofing article 100. Exposed first and second channels 108, 110 can be filled with a material, such as foam (e.g., polyurethane foam). This step of foaming can be done when edge flashing is installed. This step of foaming can be done to close the respective open channels, as well as providing additional structural integrity or support to the article. Edge flashing can be used to cover the ends of roofing articles 100 along the roof slope line (i.e., gable ends).

Roofing article 100 can be positioned and pushed firmly against the starting or base unit 152 so that tabs 144 line up with the receiver pockets 152. One or more mechanical fasteners can be installed in bores 116. Again, working left to right, another roofing article 100 can be installed—this can be repeated until the roof deck is covered. These steps can be repeated for other portions of roof. A ridge vent cap 28 can be placed over the roofing articles 100 and their respective outlet ports 134. The ridge cap can then be fastened through roofing articles 100 to the roof deck (12).

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g. 1 to 5 includes 1, 1.5, 2, 2.75, 3, 3.80, 4, and 5). In addition, all numbers used herein are assumed to be modified by the term 'about'. Various exemplary embodiments have been described. These and other embodiments are within the scope of the following claims.

The invention claimed is:

1. A roofing article for installation on a roof deck, said roofing article comprising:

a body;

a first channel defined within an upper portion of said body, said first channel comprising an inlet through which outside air can enter said first channel; and a second channel defined in a lower portion of said body, wherein a sheet separates said second channel from said first channel, said second channel being operably connected to said first channel through an orifice in said sheet such that the outside air can enter said second channel through said orifice;

wherein said second channel comprises an outlet port, wherein the outside air can exit said second channel through said outlet port; and wherein said second channel comprises an inlet port, wherein said inlet port can mate and be in general alignment with the outlet port of a corresponding adjacent roofing article and said outlet port can mate and be in general alignment with the inlet port of another corresponding adjacent roofing article, so that the second channels of adjacent roofing articles can be in airflow communication so as to create an airflow path between said adjacent roofing articles, wherein said first channel and said second channel are enclosed.

2. The roofing article of claim 1, wherein said second channel is in airflow communication with an unconditioned space and wherein unconditioned air from the unconditioned space can enter said second channel through said inlet port.

3. The roofing article of claim 2, wherein the unconditioned air entering said second channel through said inlet port can mix with outside air entering said second channel through said orifice to form mixed air, wherein said mixed air can exit said second channel through said outlet port.

4. The roofing article of claim 2, wherein the unconditioned space is an attic.

5. The roofing article of claim 1, further comprising insulation presented below said second channel.

6. The roofing article of claim 1, wherein said first channel comprises an first channel upper internal surface and a first channel lower internal surface, wherein one or more of said first channel upper and lower internal surfaces comprises a radiant barrier presented therewith.

7. The roofing article of any claim 1, wherein said second channel comprises an second channel upper internal surface and a second channel lower internal surface, wherein one or more of said second channel upper and lower internal surfaces comprises a radiant barrier presented therewith.

8. The roofing article of any of claim 1, further comprising a third channel defined in a lower portion of said body, wherein a second sheet separates said third channel from said second channel.

9. The roofing article of claim 8, wherein said third channel is in airflow communication with an unconditioned space.

10. The roofing article of claim 9, wherein the unconditioned space is an attic.

11. The roofing article of claim 1, further comprising an air director presented in said first channel proximate said orifice to direct outside air into orifice.

12. The roofing article of claim 1, further comprising an airflow interrupter presented with said air pathway for at least partially closing at least one of said first channel or said second channel when said airflow interrupter is exposed to temperatures at or greater than about 350 degrees Fahrenheit.

13. The roofing article of claim 12, wherein said airflow interrupter comprises an intumescent material.

14. The roofing article of claim 1, further comprising a cover presented with said inlet, said cover enabling outside air to flow therethrough into said first channel.

15. The roofing article of claim 1, wherein a ratio of a cross section of said inlet to a cross section of said orifice is between about 2 to about 48.

16. The roofing article of claim 1, wherein a ratio of a cross section of said inlet to a cross section of said orifice is between about 1to about 12.

* * * * *